US011238785B2

(12) United States Patent
Kim

(10) Patent No.: US 11,238,785 B2
(45) Date of Patent: Feb. 1, 2022

(54) DISPLAY DEVICE

(71) Applicant: Samsung Display Co., Ltd., Yongin-Si (KR)

(72) Inventor: Jong Soo Kim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/101,025

(22) Filed: Nov. 23, 2020

(65) Prior Publication Data

US 2021/0304663 A1 Sep. 30, 2021

(30) Foreign Application Priority Data

Mar. 25, 2020 (KR) ..... 10-2020-0036194

(51) Int. Cl.
*G09G 3/32* (2016.01)

(52) U.S. Cl.
CPC ..... *G09G 3/32* (2013.01); *G09G 2310/027* (2013.01); *G09G 2310/08* (2013.01); *G09G 2320/0233* (2013.01)

(58) Field of Classification Search
CPC ..... G09G 2310/08; G09G 2310/027; G09G 2320/0233; G09G 3/32
See application file for complete search history.

(56) References Cited

U.S. PATENT DOCUMENTS

| | | | | |
|---|---|---|---|---|
| 10,157,590 | B1 * | 12/2018 | Aflatooni | G09G 5/10 |
| 10,176,756 | B2 | 1/2019 | Hwang et al. | |
| 10,276,640 | B2 | 4/2019 | Chung et al. | |
| 10,331,164 | B2 | 6/2019 | Bao | |
| 2017/0169275 | A1 * | 6/2017 | Mackey | G09G 3/3426 |
| 2019/0373166 | A1 * | 12/2019 | Jia | H04N 5/2257 |
| 2020/0227508 | A1 * | 7/2020 | Kim | G09G 3/3233 |
| 2021/0043166 | A1 * | 2/2021 | Zhao | G09G 5/14 |
| 2021/0084236 | A1 * | 3/2021 | Han | G06K 9/00013 |

FOREIGN PATENT DOCUMENTS

| | | |
|---|---|---|
| KR | 10-2017-0029041 A | 3/2017 |
| KR | 10-2018-0018888 A | 2/2018 |
| KR | 10-2019-0091557 A | 8/2019 |

* cited by examiner

*Primary Examiner* — Muhammad N Edun
(74) *Attorney, Agent, or Firm* — Innovation Counsel LLP

(57) ABSTRACT

A display device of the present inventive concept includes: a display panel include a first display area including a first pixel area in which first pixels are disposed and a transmissive area in which no pixel is disposed, and a second display area including a second pixel area in which second pixels are disposed; a panel driver configured to supply an analog data signal to the first and second pixels; and a camera configured to include at least one camera module for capturing an image and disposed to overlap the first display area of the display panel. The panel driver controls luminance of at least some of the first pixels in the first display area at a first time point at which the at least one camera module captures an image.

15 Claims, 16 Drawing Sheets

DISPLAY DEVICE

CROSS-REFERENCE TO RELATED APPLICATION

This application claims priority to and benefits of Korean Patent Application No. 10-2020-0036194 filed in the Korean Intellectual Property Office on Mar. 25, 2020, the entire contents of which are incorporated herein by reference.

BACKGROUND

(a) Field

The present inventive concept relates to a display device.

(b) Description of the Related Art

An electronic device (e.g., a mobile terminal, etc.) including a display device may include a display area that occupies most of a front surface (e.g., a surface on which an image is displayed) of a display device and a camera or the like that overlaps a portion of the display area.

In the meantime, in the case where a pixel disposed in a portion of the display area overlapping the camera emits light when the camera captures an image, interference between light emitted from the pixel and light reflected from a subject and incident on a light receiver of the camera may occur, thereby deteriorating the quality of an image captured by the camera. Particularly, when the sensitivity of the camera is increased during night shooting or when the pixel disposed in a portion of the display area overlapping the camera emit light with high luminance, interference of light may become stronger.

The above information disclosed in this Background section is only for enhancement of understanding of the background of the inventive concept, and therefore it may contain information that does not form the prior art that is already known in this country to a person of ordinary skill in the art.

SUMMARY

One object of the present inventive concept is to provide a display device that minimizes (or eliminates) an interference effect between light emitted from a pixel and light reflected from a subject and incident on a light receiver of a camera.

An exemplary embodiment of the present inventive concept provides a display device including: a display panel which includes a first display area including a first pixel area in which first pixels are disposed and a transmissive area in which no pixel is disposed, and a second display area including a second pixel area in which second pixels are disposed; a panel driver configured to supply an analog data signal to the first and second pixels; and a camera configured to include at least one camera module for capturing an image and disposed to overlap the first display area of the display panel. The panel driver may control luminance of at least some of the first pixels in the first display area at a first time point at which the at least one camera module captures an image.

In an exemplary embodiment, the panel driver may reduce the luminance of the at least some of the first pixels or turns off the at least some of the first pixels at the first time point.

In an exemplary embodiment, the display device may further include: a camera driver configured to supply a camera driving signal including photographing time point information at the first time point to the camera; and a host processor configured to supply a camera control signal to the camera driver and to supply a first data and a control signal to the panel driver. The camera driver may generate the camera driving signal in response to the camera control signal, and the at least one camera module may capture an image at the first time point based on the camera driving signal.

In an exemplary embodiment, the panel driver may include: a timing controller configured to convert the first data into second data; and a data driver configured to generate the analog data signal based on the second data.

In an exemplary embodiment, the timing controller may generate an offset control signal and a selection signal including the photographing time point information in response to the control signal. The data driver may include: an offset circuit configured to generate an offset applied to the second data based on the offset control signal; and a signal generator configured to generate the analog data signal corresponding to the at least some of the first pixels based on the second data, the offset, and the selection signal.

In an exemplary embodiment, the signal generator may include: a multiplexer (MUX) configured to select one of first sub-data in which the offset is applied to the second data and second sub-data in which no offset is applied to the second data; and a digital-analog converter configured to convert the first sub-data or the second sub-data selected from the MUX into the analog data signal.

In an exemplary embodiment, the signal generator may supply the analog data signal converted from the first sub-data to the at least some of the first pixels, and luminance of the at least some of the first pixels may be changed based on the analog data signal converted from the first sub-data at the first time point.

In an exemplary embodiment, the signal generator may include: a MUX configured to select one of a first offset signal including the offset and a second offset signal including no offset in response to the selection signal; and a digital-analog converter configured to convert first sub-data in which the first offset signal is applied to the second data or second sub-data in which the second offset signal is applied thereto to the analog data signal.

In an exemplary embodiment, the display device may further include: an illuminance sensor configured to sense illuminance of ambient light of the display panel and to supply illuminance data corresponding to the illuminance to the host processor. The offset may be determined based on the illuminance data included in the control signal.

In an exemplary embodiment, the first pixels may be disposed to have first density in an area of the first display area that overlaps the camera, and the second pixels may be disposed to have second density that is higher than the first density in the second display area.

In an exemplary embodiment, the display device may further include: a camera driver; and a host processor configured to supply first data and a control signal to the panel driver. The panel driver may generate a camera control signal in response to the control signal, and the camera driver may supply a camera driving signal including photographing time point information corresponding to the first time point to the camera in response to the camera control signal.

In an exemplary embodiment, the panel driver may include: a timing controller configured to convert the first data into second data; and a data driver configured to generate the analog data signal based on the second data.

In an exemplary embodiment, the timing controller may generate an offset control signal and a selection signal based on the control signal. The data driver may include: an offset circuit configured to generate an offset applied to the second data based on the offset control signal; and a signal generator configured to generate the analog data signal corresponding to the at least some of the first pixels based on the second data, the offset, and the selection signal.

In an exemplary embodiment, the data driver may generate sub-data to which the offset is applied to the second data based on the offset and the selection signal, and may convert the sub-data into the analog data signal to supply the analog data signal to the at least some of the first pixels. Luminance of the at least some of the first pixels may be changed based on the analog data signal converted from the sub-data.

In an exemplary embodiment, the panel driver may supply the camera control signal to the camera driver after supplying the analog data signal converted from the sub-data to the at least some of the first pixels. The camera driver may generate the camera driving signal in response to the camera control signal, and the at least one camera module may capture an image at the first time point in response to the camera driving signal.

In an exemplary embodiment, the display device may further include: a camera driver; and a host processor configured to supply a camera control signal to the camera driver and to supply first data to the panel driver.

In an exemplary embodiment, the camera driver may generate a command in response to the camera control signal. The panel driver may control luminance of at least some of the first pixels in response to the command.

In an exemplary embodiment, the panel driver may include: a timing controller configured to convert the first data into second data and to generate an offset control signal and a selection signal based on the command; and a data driver configured to generate the analog data signal based on the second data. The data driver may include: an offset circuit configured to generate an offset applied to the second data in response to the offset control signal; and a signal generator configured to generate the analog data signal corresponding to the at least some of the first pixels based on the second data, the offset, and the selection signal.

In an exemplary embodiment, the data driver may generate sub-data to which the offset is applied to the second data based on the offset and the selection signal, and may convert the sub-data into the analog data signal to supply the analog data signal to the at least some of the first pixels. Luminance of the at least some of the first pixels may be changed based on the analog data signal converted from the sub-data.

In an exemplary embodiment, the panel driver may supply a response signal to the camera driver after supplying the analog data signal converted from the sub-data to the at least some of the first pixels. The camera driver may supply a camera driving signal including photographing time point information corresponding to the first time point to the camera in response to the response signal, and the at least one camera module may capture an image at the first time point in response to the camera driving signal.

The display device according to the exemplary embodiment of the present inventive concept may reduce the luminance of pixels disposed in the area overlapping the camera at a time at which the camera captures an image, based on the data signal to which the offset is applied. Accordingly, an interference effect between the light emitted from the pixel and the light reflected from the subject and incident on the light receiver of the camera is minimized (or removed), thereby improving the quality of the captured image.

DETAILED DESCRIPTION OF THE EMBODIMENTS

Figure 1:
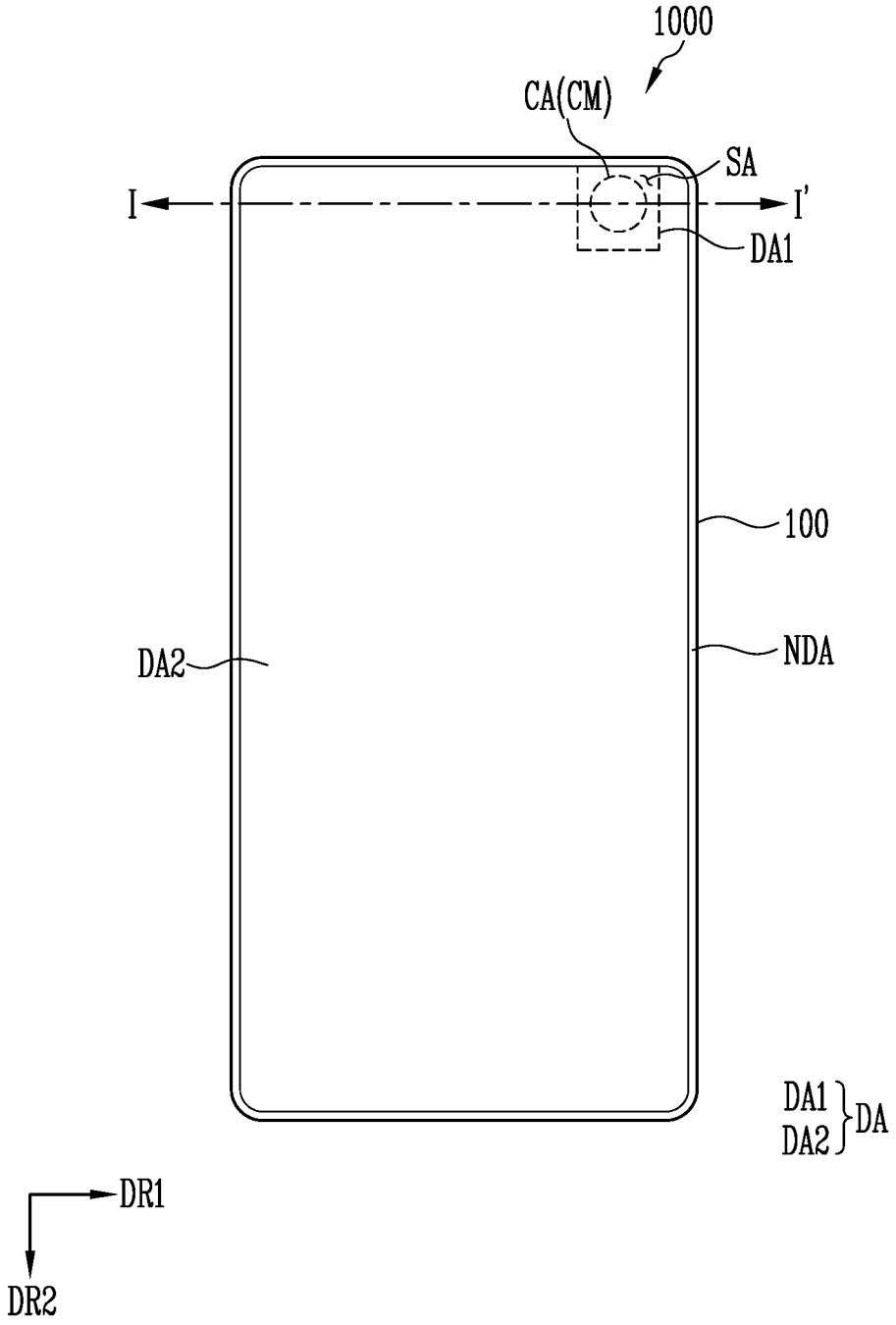
FIG. 1 illustrates a display device according to an exemplary embodiment of the present inventive concept.

Since the present inventive concept may be variously modified and have various forms, specific exemplary embodiments will be illustrated in the drawings and described in detail in this specification. However, it should be understood that the exemplary embodiments are not intended to limit the inventive concept to a specific disclosed form, and cover all modifications, equivalents, or alternatives falling within the spirit and technical scope of the inventive concept.

Like reference numerals are used for like elements in describing each drawing. In the accompanying drawings, the dimensions of the structures are shown to be enlarged than the actual for clarity of the present inventive concept. Terms such as first, second, and the like will be used only to describe various components, and are not to be interpreted as limiting these components. The terms are only used to differentiate one component from other components. For example, a first constituent element may be referred to as a second constituent element, and the second constituent element may also be referred to as the first constituent element without departing from the scope of the present inventive concept. Singular forms are to include plural forms unless the context clearly indicates otherwise.

It will be further understood that terms "comprises/includes" or "have" used in the present specification specify the presence of stated features, numerals, steps, operations, components, parts, or a combination thereof, but do not preclude the presence or addition of one or more other features, numerals, steps, operations, components, parts, or a combination thereof. It will be understood that when an element such as a layer, film, region, or substrate is referred to as being "on" another element, it can be directly on the other element or intervening elements may also be present. In addition, in the present specification, when it is said that a portion of a layer, film, region, plate, etc. is formed on another part, the formed direction is not limited to an upper direction, but includes a side or a lower direction. Conversely, it will be understood that when an element such as a layer, film, region, or substrate is referred to as being "below" another element, it can be directly below the other element or intervening elements may also be present.

Figure 2:
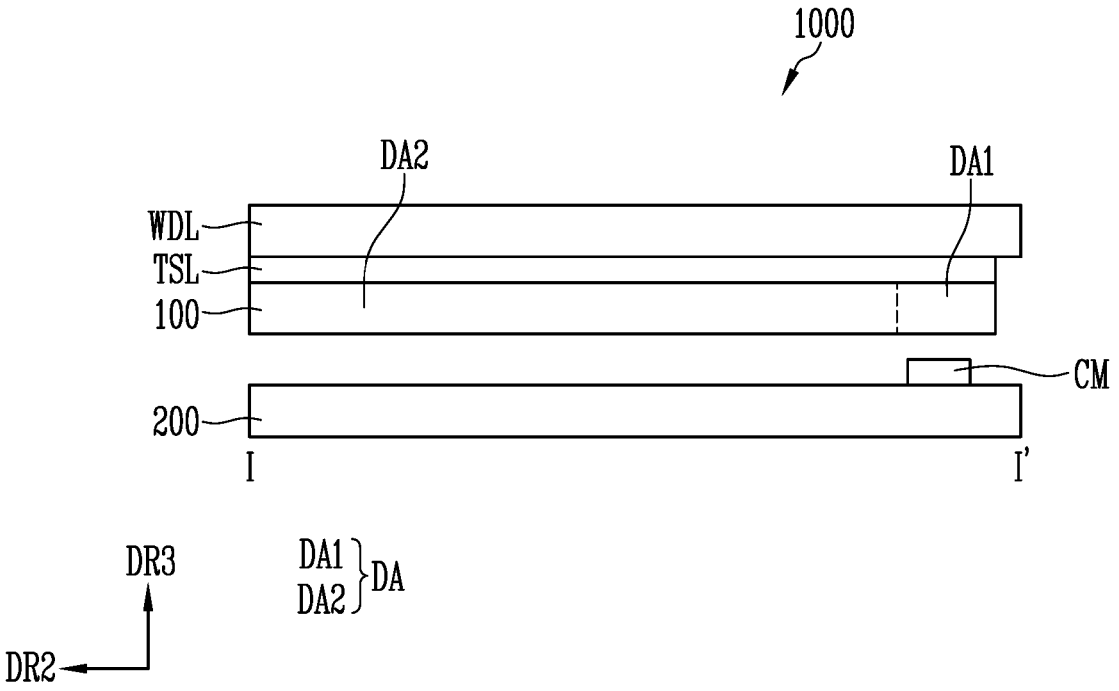
FIG. 2 illustrates a cross-sectional view of section I-I' of FIG. 1 showing an example of the display device of FIG. 1.

Hereinafter, exemplary embodiments of the present inventive concept will be described in more detail with reference to accompanying drawings FIG. 1 illustrates a display device according to an exemplary embodiment of the present inventive concept, and FIG. 2 illustrates a cross-sectional view of section I-I' showing an example of the display device of FIG. 1.

Referring to FIG. 1 and FIG. 2, the display device 1000 may include a display panel 100, a base 200, and a camera CM. In an exemplary embodiment, the display device 1000 may further include a touch sensor layer TSL and a window layer WDL.

The display device 1000 may be applied to various electronic devices such as a smart phone, a tablet, a smart pad, a TV, and a monitor.

The base 200 may support the display panel 100 and the camera CM. In an exemplary embodiment, the base 200 may be a bracket, a case, etc., and may include a plastic or metal material. The base 200 may constitute an external shape of a rear surface of the display device 1000 to protect constituent elements inside the electronic device from external stress.

In an exemplary embodiment, the display panel 100 may be a flat panel display panel or a flexible display panel. For example, the display panel 100 may include a rigid substrate formed of glass, plastic, or the like, or a flexible substrate such as a plastic film. The display panel 100 may display an image by using a pixel circuit (a plurality of transistors) disposed on a substrate and a light emitting element such as an organic light emitting diode. The light emitting element and the pixel circuit may be covered with a thin film encapsulation layer. The thin film encapsulation layer may prevent deterioration of properties by sealing the light emitting element from an external environment including moisture and oxygen. Herein, the light emitting element is not limited to an organic light emitting diode. For example, the light emitting element may be an inorganic light emitting element including an inorganic light emitting material or a light emitting element (quantum dot display element) that emits light by changing a wavelength of light emitted using quantum dots.

The display panel 100 may include a display area DA including a plurality of pixels and a non-display area NDA disposed at at least one side of the display area DA. An entire front surface of the display panel 100 may substantially correspond to the display area DA in order to minimize the non-display area NDA (e.g., a bezel)

Although it is illustrated that the non-display area NDA is provided at a portion of the front surface of the display panel 100, the present inventive concept is not limited thereto. For example, an edge display may be implemented by extending the display area DA to at least one side of the display panel 100, and in this case, the non-display area NDA may be partially provided on a side surface of the display panel 100.

The display area DA may include first and second display areas DA1 and DA2.

The first display area DA1 may have a portion overlapping the camera CM. The first display area DA1 may include a camera area CA overlapping the camera CM and a surrounding area SA adjacent to the camera area CA.

The first display area DA1 includes first pixels. The first pixels may be disposed to have a first pixel density in at least a portion of the first display area DA1. For example, the first pixels may be disposed to have the first pixel density in the camera area CA overlapping the camera CM in the first display area DA1, and may be disposed to have a second pixel density in an area (e.g., the surrounding area SA) except for the camera area CA in the first display area DA1. Herein, the second pixel density may be greater than the first pixel density. As another example, the first pixels may be disposed to have the first pixel density in the entire first display area DA1 (i.e., the camera area CA and the surrounding area SA). However, the present inventive concept is not limited thereto, and the second pixels included in the second display area DA2 may also have the first pixel density in at least a portion of the second display area DA2.

The second display area DA2 may occupy most area of the display area DA. The second display area DA2 includes second pixels, and the second pixels may be disposed to have the second pixel density in the second display area DA2. However, the present inventive concept is not limited thereto, and the second pixels may be disposed to have a third pixel density, which is larger than the second pixel density, in the second display area DA2.

The pixel density is defined as a total area of a portion where actual pixels are disposed relative to a total area of the display area, or may be defined as a total area of pixels included in a predetermined unit area. Herein, an area where each of the pixels is disposed may be an area of emission surfaces of the light emitting elements included in the respective pixels. For example, when the pixel includes an organic light emitting element, an area of the pixel may be an area of an anode exposed between pixel defining layers or an area of an emission layer.

Accordingly, light transmittance of the first display area DA1 is higher than that of the second display area DA2, and taking photos may be performed by the camera CM disposed at a lower portion of the first display area DA1.

The camera CM may be disposed between the base 200 and the display panel 100. That is, the camera CM may be disposed below the rear surface of the display panel 100. The camera CM may overlap the first display area DA1. In FIG. 1, the first display area DA1 is formed to be wider than the camera CM, but a relationship between the first display area DA1 and the camera CM is not limited thereto. For example, the first display area DA1 and the camera CM may be formed to have substantially a same area, or the first display area DA1 may be formed to be smaller than the camera CM. In addition, in FIG. 1, the camera CM is illustrated to overlap an upper right area of the display area DA, but the present inventive concept is not limited thereto, and the camera CM may overlap an upper left area or a central upper area of the display area DA. In this case, the first display area DA1 may also be disposed in the upper left area or the upper center area.

The camera CM may include at least one camera module for capturing an image. The display device 1000 may photograph a subject by using the camera CM. The camera CM may take an image through a transmitting window disposed in the transmissive area.

However, this is an example, and the present inventive concept is not limited to such disposal of only the camera module for image capture in the camera CM. For example, the camera CM may be replaced with a biometric sensor.

The higher the aperture ratio (transmittance) of the first display area DA1 corresponding to the camera CM, the higher the quality of the image captured by the camera CM may be. Accordingly, at least the first pixels disposed in the camera area CA of the first display area DA1 may be disposed to have a lower pixel density than the second pixels disposed in the second display area DA2. For example, a number of pixels per unit area (PPI) of the first display area DA1 may be lower than that of pixels per unit area of the second display area DA2.

In an exemplary embodiment, the camera CM may further include a fixing member surrounding the camera module and a moving member connected to the camera module to move the camera module.

In an exemplary embodiment, a touch sensor layer TSL may be disposed on the display panel 100. The touch sensor layer TSL may be disposed to correspond to a front surface of the display area DA of the display panel 100, or may be formed to have a larger area than the display area DA while covering the display area DA. According to an exemplary embodiment, the touch sensor layer TSL may be driven by a capacitive method, a resistive film method, or the like.

The touch sensor layer TSL may be disposed on the display panel 100 through an adhesive member, or may be directly disposed on the display panel 100 through a continuous process such as patterning in a manufacturing process of the display panel 100. However, this is an example, and the touch sensor layer TSL may be disposed inside the display panel 100.

A window layer WDL may be disposed on the touch sensor layer TSL. The window layer WDL may be disposed at an outermost portion of a front surface (i.e., a display surface) of the display device 1000 to protect constituent elements inside the display device 1000 from external shocks, scratches, and the like. The window layer WDL may be formed by using a glass material or a polymer film. For example, the window layer WDL may include at least one of polyimide, polyethylene terephthalate (PET), and other polymer materials. The window layer WDL may be made of a transparent material.

Figure 3A:
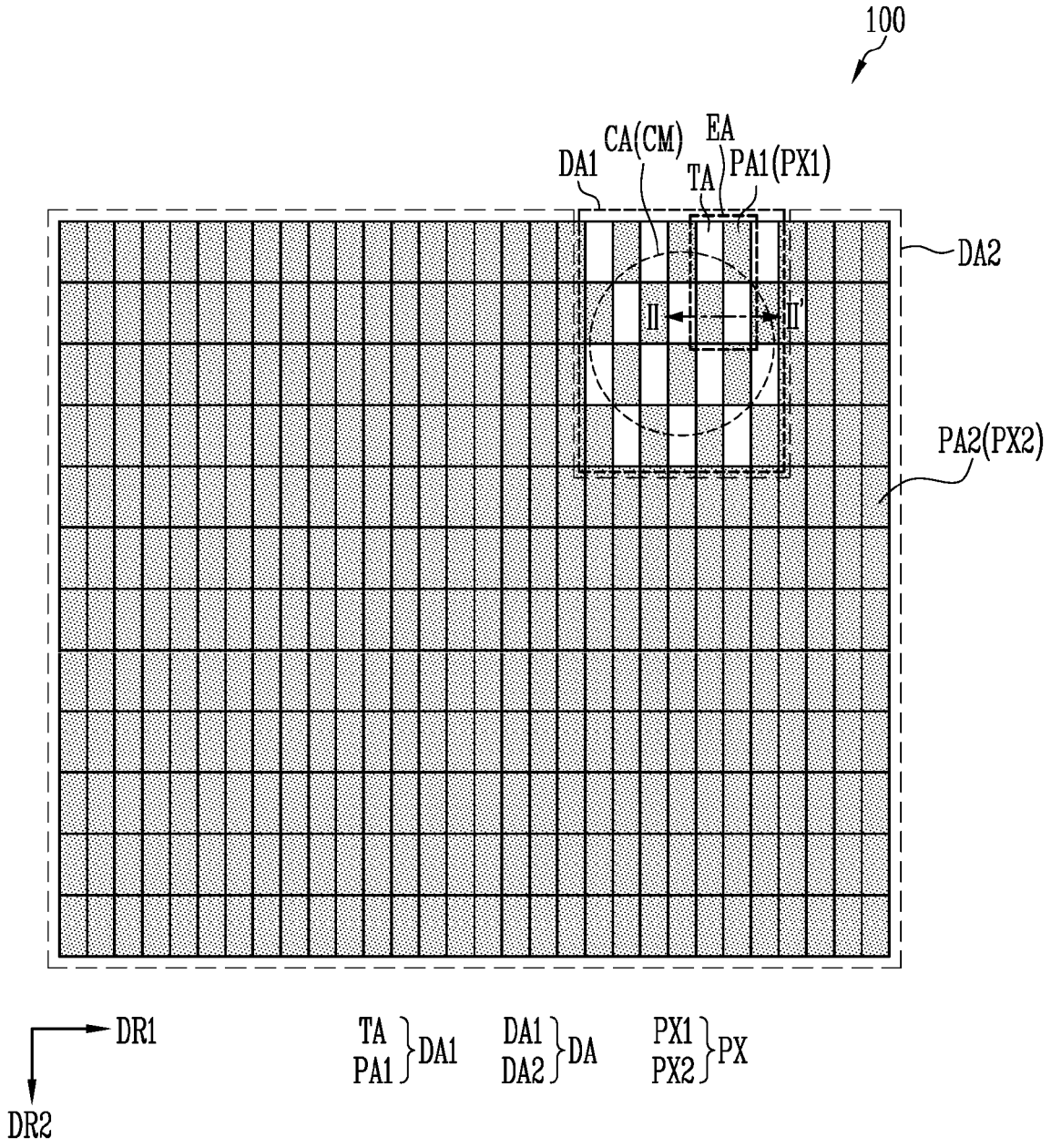
FIG. 3A illustrates an example of a display panel included in the display device of FIG. 1.
Figure 3B:
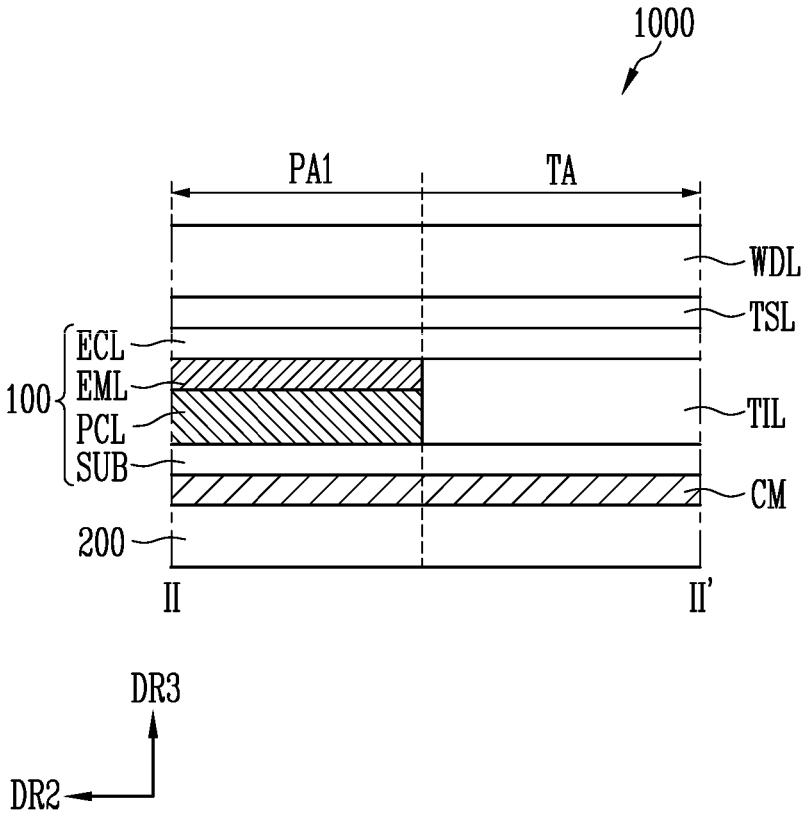
FIG. 3B illustrates a schematic cross-sectional view of section II-II' of FIG. 3A showing an example of some regions of a pixel area and a transmissive area included in a display area of the display panel of FIG. 3A.
Figure 3C:
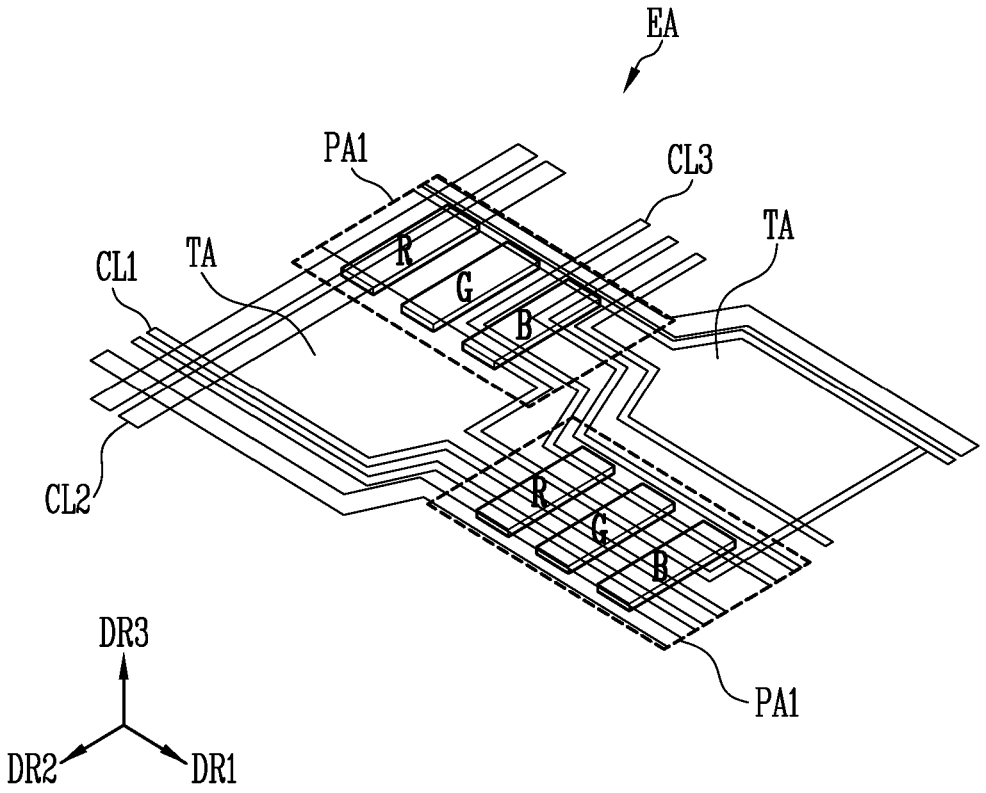
FIG. 3C illustrates a schematic perspective view showing an example of an area EA included in the display area of the display panel of FIG. 3A.

FIG. 3A illustrates an example of a display panel included in the display device of FIG. 1, FIG. 3B illustrates a schematic cross-sectional view of section II-II' showing an example of some regions of a pixel area and a transmissive area included in a display area of the display panel of FIG. 3A, and FIG. 3C illustrates a schematic perspective view showing an example of an area EA included in the display area of the display panel of FIG. 3A.

Referring to FIG. 1 and FIG. 3A to 3C, the display panel 100 may include first and second display areas DA1 and DA2. As described with reference to FIG. 1 and FIG. 2, the first pixels PX1 are disposed to have the first pixel density in the camera area CA overlapping the camera CM in the first display areas DA1, or may be disposed to have the first pixel density in the entire first display area DA1, but hereinafter, as illustrated in FIG. 3A, it is assumed that the first pixels PX1 are disposed to have the first pixel density in the entire first display area DAL In an exemplary embodiment, in the display area DA, a pixel row may be defined by pixels PX arranged in the first direction DR1, and a pixel column may be defined by pixels PX arranged in a second direction DR2 intersecting the first direction DR1.

The first display area DA1 may have a portion (e.g., the camera area CA) overlapping the camera CM. In an exemplary embodiment, the first display area DA1 may have a first pixel area PA1 in which the first pixel PX1 is disposed and a transmissive area TA in which no pixel is disposed.

In an exemplary embodiment, light emitting elements and transistors constituting the pixels are not disposed in the transmissive area TA. That is, it may be understood that the meaning that no pixel is disposed is that the light emitting element and the transistors constituting the pixel circuit are not disposed (or formed).

In an exemplary embodiment, the first pixel area PA1 and the transmissive area TA included in the first display area DA1 may have a stacked structure in the third direction DR3 as illustrated in FIG. 3B. The camera CM disposed on the base 200 such as a case may overlap both the first pixel area PA1 and the transmissive area TA.

The display panel 100 may include a substrate SUB, a pixel circuit layer PCL, a light emitting element layer EML, and an encapsulation layer ECL.

The substrate SUB may be formed to include a single layer or a plurality of layers made of a transparent insulating material such as glass or transparent plastic (PI).

The pixel circuit layer PCL may be disposed in the first pixel area PA1 on the substrate SUB. The pixel circuit layer PCL includes at least one transistor, a capacitor, and a signal line connected to the light emitting element. The pixel circuit layer PCL may be formed by mutually stacking a semiconductor layer, a plurality of insulating layers, and a plurality of conductive layers. In addition, as illustrated in FIG. 3C, a plurality of signal lines CL1, CL2, and CL3 may be connected to the pixel circuit layer PCL. For example, the signal lines CL1, CL2, and CL3 may include a scan line for transferring a scan signal, a data line for transferring a data signal, a light emission control line for transferring a light emission control signal, a power line for transferring a power voltage, and the like.

In an exemplary embodiment, the pixel circuit layer PCL and the signal lines CL1, CL2, and CL3 may be disposed not to overlap the transmissive area TA. However, this is an example, and at least some of the signal lines CL1, CL2, and CL3 may be formed to pass through the transmissive area TA.

A light emitting element layer EML may be disposed on the pixel circuit layer PCL. The light emitting element layer EML may include a plurality of electrode layers and an emission layer. The light emitting element layer EML may also be disposed not to overlap the transmissive area TA.

For example, when the light emitting element layer EML is made of an organic light emitting element, the light emitting element layer EML may include a first electrode layer (e.g., anode electrode layer), a second electrode layer (e.g., cathode electrode layer), and an organic emission layer disposed between the first electrode layer and the second electrode layer. However, the second electrode layer may be formed as a common electrode layer, or may be disposed to extend to the transmissive area TA as a transparent electrode.

In an exemplary embodiment, as illustrated in FIG. 3C, the first pixel PX1 included in the first pixel area PA1 may include a plurality of sub-pixels R, G, and B. Each of the sub-pixels R, G, and B may emit light of different colors. For example, each of the sub-pixels R, G, and B may emit red light, green light, or blue light.

A transparent insulating layer TIL may be disposed in the transmissive area TA on the substrate SUB. In an exemplary embodiment, the transparent insulating layer TIL may have a structure in which at least one inorganic insulating layer and at least one organic insulating layer are stacked. However, the present inventive concept is not limited thereto, and the transparent insulating layer TIL may be omitted and formed as another material (e.g., a transparent adhesive material) layer or an air layer, or the encapsulation layer ECL may be bonded to the substrate SUB.

As illustrated in FIG. 3C, the signal lines CL1, CL2, and CL3 may also be disposed not to overlap the transmissive area TA in order to improve an aperture ratio. However, this is an example, and at least some of the signal lines CL1, CL2, and CL3 may be disposed to overlap the transmissive area TA to pass through the transmissive area TA, and the signal lines CL1, CL2, and CL3 passing through the transmissive area TA may be formed of a transparent conductive material.

An encapsulation layer ECL may be disposed on the light emitting element layer EML and the transparent insulating layer TIL. The encapsulation layer ECL may be formed by alternating disposal of glass or at least one inorganic insulating layer and at least one organic insulating layer.

A touch sensor layer TSL and a window layer WDL may be sequentially disposed on the encapsulation layer ECL.

As described above, the transmissive area TA may be understood as an area in which the pixel (or the first pixel PX1) is removed in the display area DA (or the first display area DA1), and the camera CM may take an image through light reflected from the subject and incident on the light receiver of a camera module included in the camera CM through the transmissive area TA.

In an exemplary embodiment, the first display area DA1 may include a plurality of pixel rows. In each of the pixel rows of the first display area DA1, the transmissive areas TA may be positioned at a distance corresponding to a width of one first pixel area PAL In this case, one or more first pixels PX1 may be disposed in a first pixel row included in the first display area DA1, and may be disposed in a second pixel row of the first display area DA1 so as to be non-overlapped with the one or more first pixels PX1 disposed in an adjacent pixel column. However, the distance between the transmissive areas TA is not limited thereto, but the transmissive areas TA may be positioned at a distance corresponding to a width that is smaller than a width of one first pixel area PA1, or may be positioned at a distance corresponding to a width that is larger than the width of one first pixel area PAL The first pixel areas PA1 and the transmissive areas TA may be alternately disposed along the first direction DR1 and the second direction DR2 to form a check pattern as illustrated in FIG. 3A to minimize image quality deterioration while securing transmittance of the first display area DA1. However, this is an example, and a position and disposal relationship between the first pixel areas PA1 and the transmissive areas TA of the first display area DA1 are not limited thereto.

The second display area DA2 may occupy most of an area of the display area DA. In an exemplary embodiment, the second display area DA2 may include a second pixel area PA2 in which the second pixel PX2 is disposed. The second display area DA2 may include no transmissive area TA.

As illustrated in FIG. 3A, first pixel density of the first display area DA1 may be about half (or less than half) of second pixel density of the second display area DA2. For example, the number of the first pixels PX1 included in one pixel row of the first display area DA1 may be half (or less than half) of that of the second pixels PX2 included in one pixel row of the second display area DA2. Herein, since the second pixels PX2 are similar to the first pixels PX1 described with reference to FIG. 3A to FIG. 3C, a detailed description will be omitted. In an exemplary embodiment, the second pixels PX2 may have a sub-pixel structure, a wire width, and the like that are different from those of the first pixels PX1.

Figure 4:
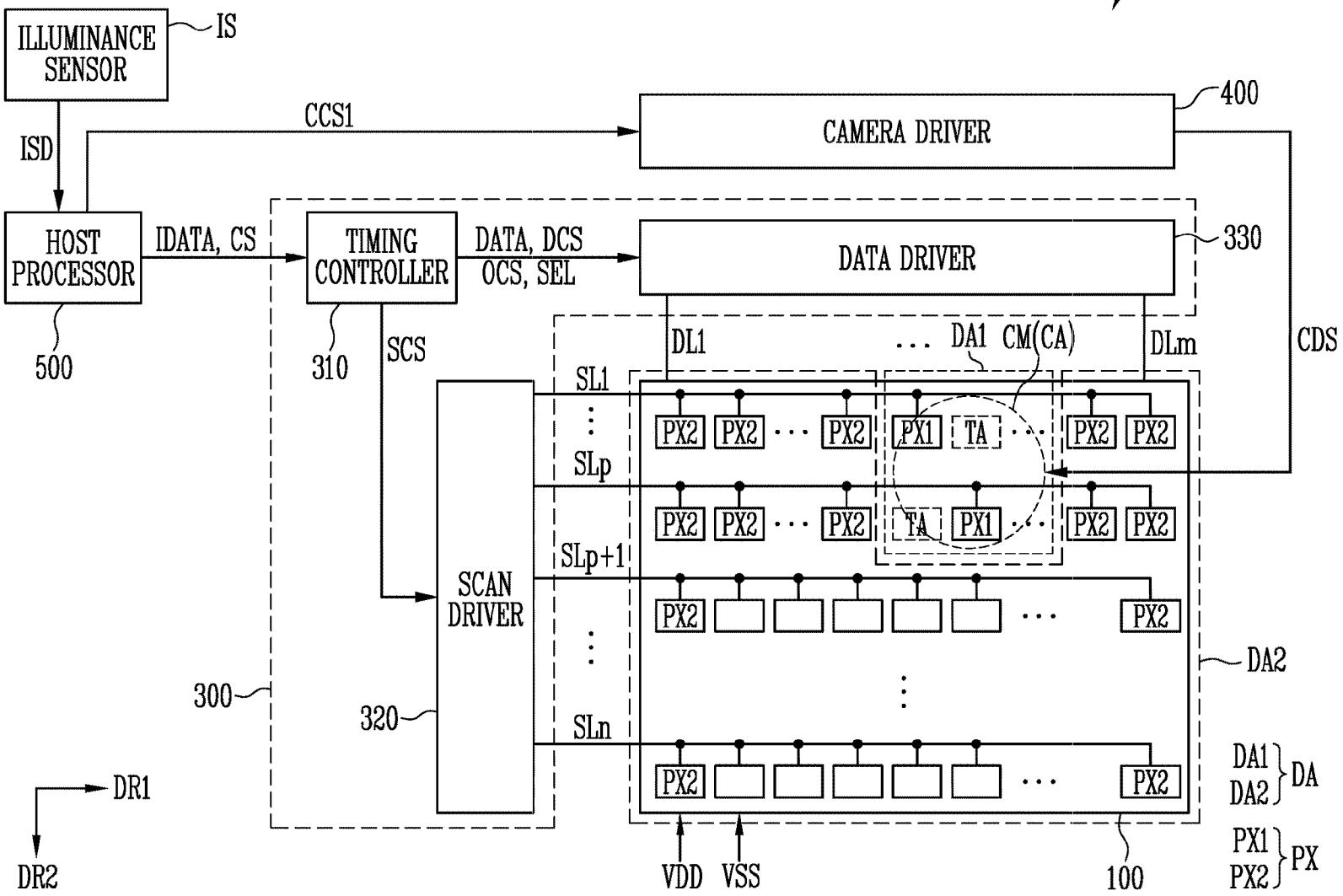
FIG. 4 illustrates a block diagram showing an example of the display device of FIG. 1.
Figure 5:
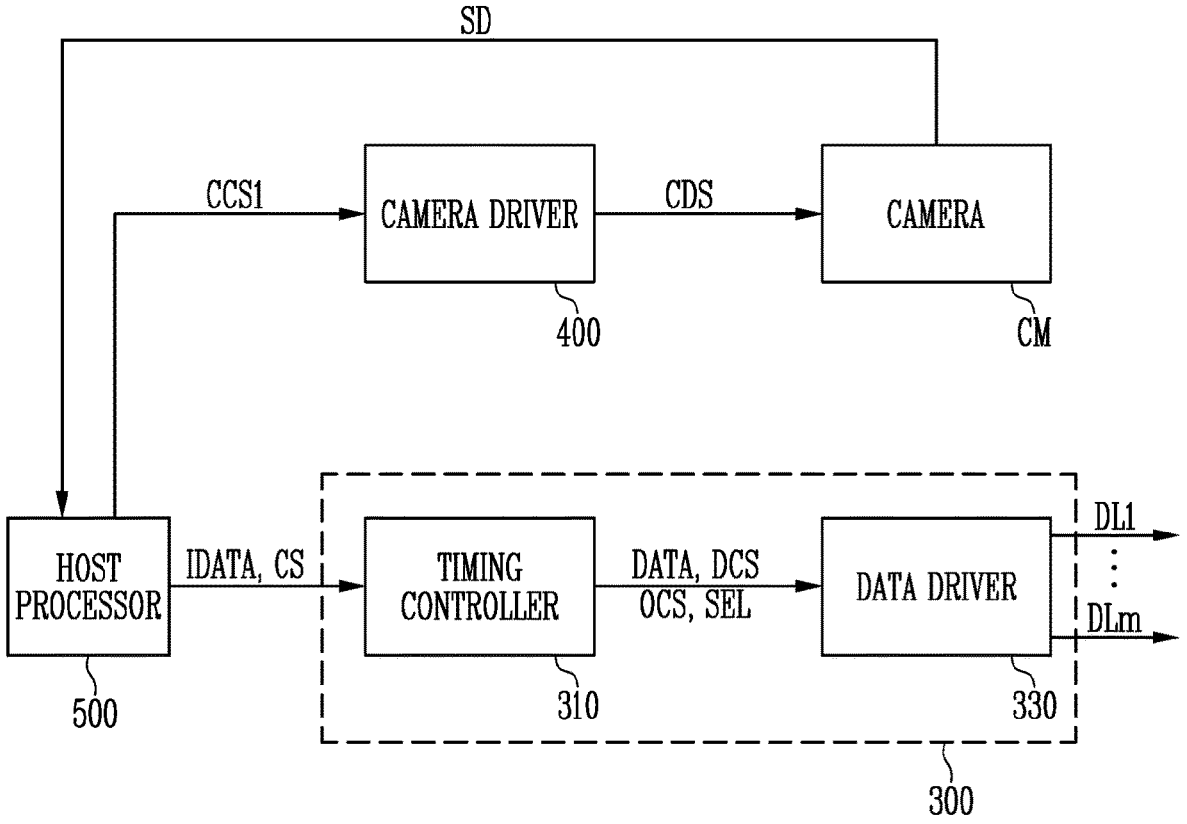
FIG. 5 illustrates an example of a host processor, a panel driver, a camera driver, and a camera included in the display device of FIG. 4.

FIG. 4 illustrates a block diagram showing an example of the display device of FIG. 1, and FIG. 5 illustrates an example of a host processor, a panel driver, a camera driver, and a camera included in the display device of FIG. 4.

In FIG. 4 and FIG. 5, substantially the same or similar constituent elements described with reference to FIG. 1 to FIG. 3A will be denoted by the same reference numerals, and a repeated description thereof will be omitted. Meanwhile, in FIG. 5, only some of the constituent elements included in the panel driver 300 are illustrated.

Referring to FIG. 4 and FIG. 5, the display device 1000 may include a display panel 100, a host processor 500, a panel driver 300, a camera driver 400, a camera CM, and an illuminance sensor IS.

In an exemplary embodiment, the display device 1000 may further include a light emission driver configured to supply a light emission control signal to the pixels PX and a power supply configured to supply a first power VDD and a second power VSS to the pixels PX.

In an exemplary embodiment, the camera CM may be disposed at a lower side of the first display area DA1 of the display panel 100.

In an exemplary embodiment, the display panel 100 may include first and second display areas DA1 and DA2. Pixel density of the first and second display areas DA1 and DA2 may be different.

The first display area DA1 may include the first pixels PX1. The first display area DA1 may include first to $p^{th}$ pixel rows that are respectively connected to the first to $p^{th}$ scan lines SL1 to SLp (where p is a natural number greater than 1).

The second display area DA2 may include the second pixels PX2. The second display area DA2 may include first to $p^{th}$ pixel rows that are respectively connected to the first to $p^{th}$ scan lines SL1 to SLp, and $(p+1)^{th}$ to $n^{th}$ pixel rows that are respectively connected to the $(p+1)^{th}$ to $n^{th}$ scan lines SL(p+1) to SLn (where n is a natural number greater than p+1).

m second pixels PX2 may be connected to the $(p+1)^{th}$ to $n^{th}$ scan lines SL(p+1) to SLn (where m is a natural number greater than 1). Since the first display area DA1 is disposed to correspond to the first to $p^{th}$ scan lines SL1 to SLp, numbers of the first pixels PX1 and the second pixels PX2 connected to the first to $p^{th}$ scan lines SL1 to SLp may be smaller than m. For example, the number of second pixels PX2 connected to the $n^{th}$ scan line SLn may be greater than the numbers of the first pixels PX1 and the second pixels PX2 connected to the first scan line SL1. In addition, the second display area DA2 may include no transmissive area TA.

The pixels PX may include the first pixels PX1 disposed in the first display area DA1 and the second pixels PX2 disposed in the second display area DA2. The pixels PX may be connected to at least one of the first to $n^{th}$ scan lines SL1 to SLn and at least one of the first to $m^{th}$ data lines DL1 to DLm. The pixels PX may receive scan signals through the first to $n^{th}$ scan lines SL1 to SLn, and may receive data signals through the first to $m^{th}$ data lines DL1 to DLm. The pixels PX may emit light with gray levels corresponding to the data signals in response to the scan signals and the data signals.

The pixels PX may receive voltages of the first power VDD and the second power VSS from an external source (e.g., a power supply). Herein, the voltages of the first and second powers VDD and VSS are voltages required for operations of the pixels PX, and the first power VDD may have a voltage level that is higher than the voltage level of the second power VSS.

The illuminance sensor IS may detect the illuminance of ambient light of the display panel 100. The illuminance sensor IS may detect illuminance to generate illuminance data ISD. The illuminance sensor IS may supply the illuminance data ISD to the host processor 500.

In an exemplary embodiment, the illuminance sensor IS may be embedded in a system board outside the display device 1000, or may be embedded in the panel driver 300. Alternatively, the illuminance sensor IS may be configured in the display device 1000 as a separate circuit or chip.

The host processor 500 may control a general operation of the display device 1000. For example, the host processor 500 may be implemented as a system-on-chip, and may be an at least one application processor (AP) provided in a mobile device.

The host processor 500 may generate first data IDATA and a control signal CS to supply the first data IDATA and the control signal CS to the panel driver 300. Herein, the first data IDATA may be input image data.

The host processor 500 may generate a camera control signal CCS1 to supply the camera control signal CCS1 to the camera driver 400. Herein, the camera control signal CCS1, which is a signal for controlling the camera driver 400, may include information related to a time point (or first time point) at which at least one camera module included in the camera CM captures an image.

The panel driver 300 may supply data signals (or data voltages) to the first and second pixels PX1 and PX2. In an exemplary embodiment, the panel driver 300 may control luminance of at least some of the first pixels PX1 at the time point (or the first time point) at which at least one camera module included in the camera CM captures an image. For example, the panel driver 300 may compensate image data (first data IDATA) corresponding to at least some of the first pixels PX1 such that illuminance of at least some of the first pixels PX1 is reduced (or turned-off) at a time point at which the camera module captures an image.

At the first time point, the panel driver 300 may control luminance of an area of the first display area DA1 overlapping the camera CM (e.g., the first pixels PX1 overlapping the camera area CA). However, the present inventive concept is not limited thereto, and for example, the panel driver 300 may control luminance of the first pixels PX1 disposed in an area (e.g., the camera area CA) overlapping the camera CM and an area adjacent thereto (e.g., the surrounding area SA of FIG. 1) at the first time point. As another example, the panel driver 300 may control luminance of the first pixels PX1 disposed in the first display area DA1 and luminance of at least some of the second pixels PX2 connected to the same scan lines (e.g., the first to $n^{th}$ scan lines SL1 to SLn) as the first pixels PX1 at the first time point.

The panel driver 300 may include a timing controller 310, a scan driver 320, and a data driver 330.

The timing controller 310 may generate a scan control signal SCS and a data control signal DCS based on the control signal CS supplied from the host processor 500. Herein, the control signal CS may include a vertical synchronization signal, a horizontal synchronization signal, a main clock signal, a data enable signal, and the like. In an exemplary embodiment, the control signal CS may further include a signal for controlling luminance of at least some of the first pixels PX1.

In an exemplary embodiment, the timing controller 310 may generate an offset control signal OCS and a selection signal SEL based on the control signal CS. The selection signal SEL may include information related to a time point at which the at least one camera module included in the camera CM captures an image (hereinafter, photographing time point information or the first time point information). Herein, the photographing time point information may be included in the control signal CS supplied from the host processor 500, and the timing controller 310 may generate the selection signal SEL including the photographing time point information based on the control signal CS. In addition, the offset control signal OCS and the selection signal SEL may correspond to signals for controlling luminance of at least some selected pixels among the first pixels PX1. When the camera CM does not capture an image, the timing controller 310 may generate the offset control signal OCS and the selection signal SEL as an OFF value. For example, when a user does not execute a camera application for image capture, the timing controller 310 may transfer the offset control signal OCS and the selection signal SEL as an off value, whereby each of the first pixels PX1 may emit light with a gray scale value corresponding to the first data IDATA (or input image data).

The timing controller 310 may generate second data DATA (or image data) by converting the first data IDATA supplied from the host processor 500.

The scan driver 320 may generate scan signals based on the scan control signal SCS supplied from the timing controller 310. Herein, the scan control signal SCS may include a scan start signal, a scan clock signal, and the like. The scan driver 320 may supply scan signals to the first to $n^{th}$ scan lines SL1 to SLn. In an exemplary embodiment, the scan driver 320 may simultaneously supply the scan signals (i.e., scan signals having a gate-on level) to all of the pixels PX, or may sequentially supply the scan signals to the first to $n^{th}$ scan lines SL1 to SLn in units of pixel rows.

The data driver 330 may generate data signals (or data voltages) based on the data control signals DCS and the second data DATA supplied from the timing controller 310. Herein, the data control signal DCS may include a source start pulse, a source shift clock, a source output enable signal, and the like. The data driver 330 may supply data signals (or data voltages) to the first to $m^{th}$ data lines DL1 to DLm. For example, the data driver 330 may convert the second data DATA in a digital format into a data signal in an analog format, and may supply the data signal to the pixels PX through the first to $m^{th}$ data lines DL1 to DLm. Herein, the second data DATA may include a gray scale value corresponding to each of the pixels PX.

In an exemplary embodiment, the data driver 330 may generate an offset signal including an offset applied to the second data DATA based on the offset control signal OCS, and may supply the data signal obtained by converting data (or sub-data) with the offset applied to the second data DATA to at least some of the first pixels PX1, based on the offset and the selection signal SEL including the photographing time point information. Herein, the offset may be determined based on the control signal CS including a predetermined value or illuminance data ISD generated by the illuminance sensor IS (i.e., illuminance of ambient light).

Luminance of at least some of the first pixels PX1 (e.g., the first pixels PX1 disposed in an area of the first display area DA1 that overlaps the camera CM) may be changed (e.g., reduced or turned-off) at a time point corresponding to the photographing time point (that is, a time point at which at least one camera module included in the camera CM takes a picture) based on the data signal to which the offset is applied. Accordingly, the luminance of the first pixels PX1 disposed in the area overlapping the camera CM is changed when the camera module captures an image, and thus interference between light emitted from the first pixels PX1 and light reflected from the subject and incident on the light receiver of the camera module may be reduced, and the quality of the image captured by the camera CM may be improved.

The camera driver 400 may generate a camera driving signal CDS based on the camera control signal CCS1 supplied from the host processor 500. Herein, the camera driving signal CDS may include photographing time point information. The camera driver 400 may supply the camera driving signal CDS to the camera CM.

The camera CM may include at least one camera module. The camera CM may be controlled based on a camera driving signal CDS supplied from the camera driver 400. For example, the camera module included in the camera CM may capture an image at a time point corresponding to the photographing time point information (i.e., the first time point) based on the camera driving signal CDS supplied from the camera driver 400. The camera CM may generate photographing data SD based on the captured image to supply the photographing data SD to the host processor 500.

In FIG. 4 and FIG. 5, the camera driver 400 and the camera CM are illustrated as separate components, but this is merely an example and the present inventive concept is not limited thereto, and for example, the camera driver 400 and the camera CM may be integrally formed.

Figure 6:
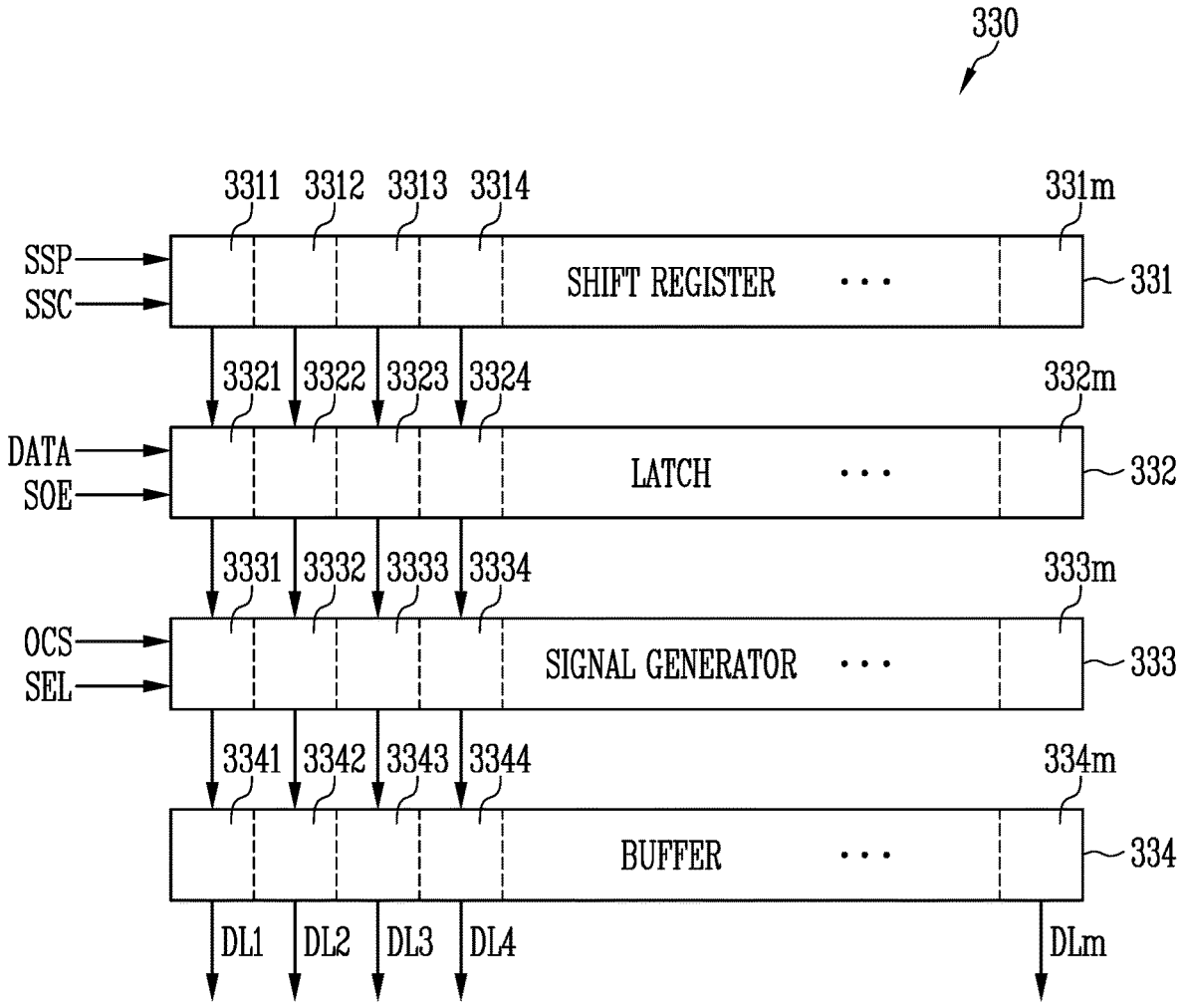
FIG. 6 illustrates an example of a data driver included in the panel driver of FIG. 5.

FIG. 6 illustrates an example of a data driver included in the panel driver of FIG. 5.

Referring to FIG. 5 and FIG. 6, the data driver 330 may include a shift register 331, a latch 332, a signal generator 333, and a buffer 334.

The shift register 331 may sequentially generate m sampling signals in response to a source start pulse SSP and a source shift clock SSC supplied from the timing controller 310. For example, the shift register 331 may sequentially generate the m sampling signals while shifting the source start pulse SSP every cycle of the source shift clock SSC. The shift register 331 may include m shift registers 3311 to 331*m*.

The latch 332 may sequentially store the second data DATA supplied from the timing controller 310 in response to the sampling signal supplied sequentially from the shift register 331. The latch 332 may latch the stored second data DATA in response to the source output enable signal SOE supplied from the timing controller 310, and may supply the latched second data DATA to the signal generator 333. The latch 332 may include m latches 3321 to 332*m*.

The signal generator 333 may convert the second data DATA supplied from the latch 332 into an analog signal, and may supply the converted analog signal to the buffer 334 as a data signal. The signal generator 333 may include m sub-signal generators 3331 to 333*m*. That is, the signal generator 333 generates m data signals by using the sub-signal generators 3331 to 333*m* disposed for each channel, and may supply the m generated data signals to the buffer 334. Each of the sub-signal generators 3331 to 333*m* may include a MUX and a digital-analog converter.

In an exemplary embodiment, the signal generator 333 may apply an offset to the second data DATA supplied from the latch 332 based on the offset control signal OCS and the selection signal SEL supplied from the timing controller 310, and may convert the second data DATA (or sub-data) to which the offset is applied to an analog signal to supply it to the buffer 334.

The buffer 334 may supply the m data signals supplied from the signal generator 333 to the m data lines DL1 to DLm. The buffer 334 may include m buffers 3341 to 334*m*. For a detailed description of the data driver 330, FIG. 7A and FIG. 7B may be referenced.

Figure 7A:
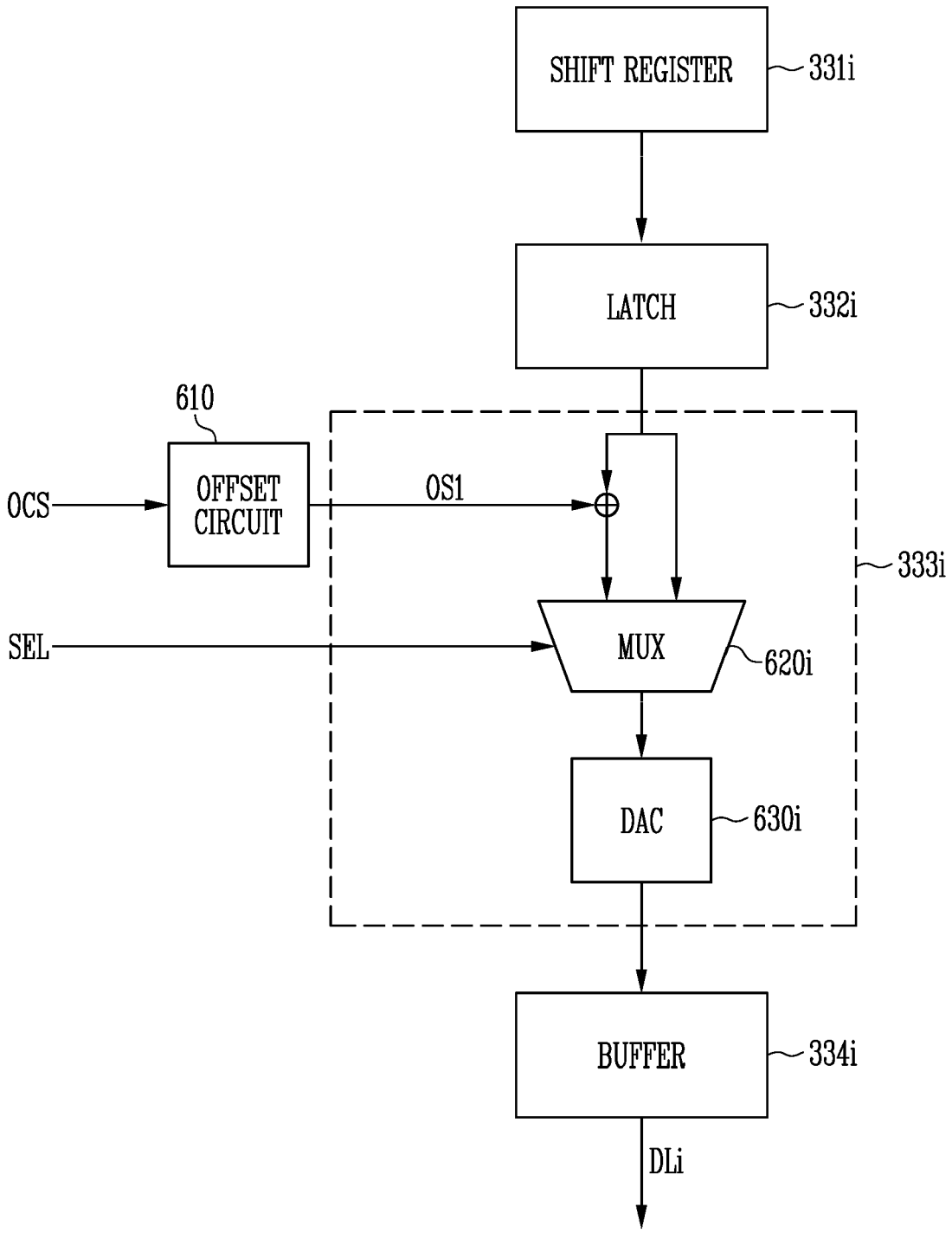
FIG. 7A illustrates an example of an operation of the data driver of FIG. 6.
Figure 7B:
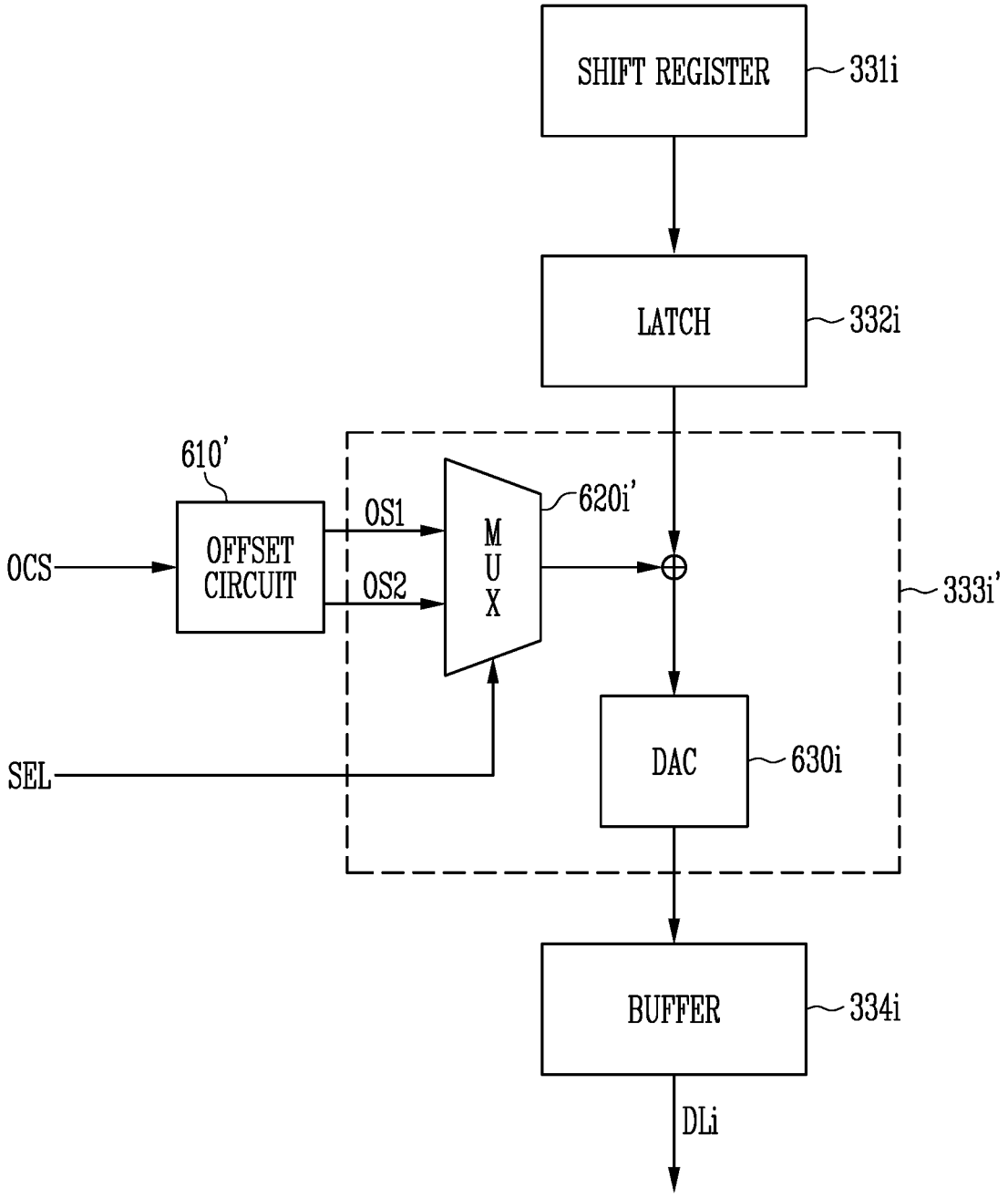
FIG. 7B illustrates another example of the operation of the data driver of FIG. 6.

FIG. 7A illustrates an example of an operation of the data driver of FIG. 6, and FIG. 7B illustrates another example of the operation of the data driver of FIG. 6.

In FIG. 7A and FIG. 7B, only a connection structure in an $i^{th}$ channel is illustrated for convenience of description.

Referring to 5 to 7A, the data driver 330 may further include an offset circuit 610.

The offset circuit 610 may generate an offset signal OS1 including an offset based on the offset control signal OCS supplied from the timing controller 310. The offset may be applied to the second data DATA, and a digital value of the second data DATA may be compensated. For example, a negative offset may be added to the second data DATA, or an offset having a predetermined ratio value may be multiplied by the second data DATA.

In an exemplary embodiment, the offset may be a predetermined value. For example, the offset may be experimentally determined to minimize (or eliminate) an effect of interference between light emitted from the pixel and light reflected from the subject when the camera module included in the camera CM (see FIG. 4) captures an image. Herein, when the camera module captures an image, the greater the luminance of light emitted from the pixel, the greater the interference effect, so the larger the luminance corresponding to the first data IDATA, the larger the offset.

In an exemplary embodiment, the offset may be determined based on the illuminance of ambient light. For example, the host processor 500 (see FIG. 4) may generate the control signal CS (see FIG. 4) based on the illumination data ISD (see FIG. 4), and the timing controller 310 may generate an offset control signal OCS based on the control signal CS (see FIG. 4). The offset circuit 610 may generate an offset signal OS1 including an offset based on the illuminance of the ambient light according to the offset control signal OCS. Herein, the lower the illuminance of the ambient light, the higher the sensitivity of the light receiver of the camera module included in the camera CM, so the interference effect may be increased, and thus the lower the illuminance of the ambient light, the greater the offset for the same gray corresponding to the first data IDATA.

In FIG. 7A, the offset circuit 610 is illustrated as having a separate configuration from the sub-signal generator 333*i*, but the present inventive concept is not limited thereto. For example, the offset circuit 610 may be integrally formed with the sub-signal generator 333*i*. In this case, each of the sub-signal generators 3331 to 333*m* may include an offset circuit.

The offset circuit 610 may provide the offset signal OS1 to the signal generator 333 (or sub-signal generator 333*i*).

The latch 332*i* may store data corresponding to an $i^{th}$ channel among the second data DATA supplied from the timing controller 310 in response to the sampling signal supplied from the shift register 331*i*. The latch 332*i* may latch the stored data in response to the source output enable signal SOE, and supply the latched data to the sub-signal generator 333*i*.

The sub-signal generator 333*i* may generate a data signal based on data supplied from the latch 332*i* (i.e., second data DATA), the offset signal OS1, and the selection signal SEL.

In an exemplary embodiment, the sub-signal generator 333*i* may include a MUX 620*i* and a digital-analog converter (DAC) 630*i*.

The MUX 620*i* may receive first sub-data to which the offset included in the offset signal OS1 is applied to the second data DATA supplied from the latch 332*i* and second sub-data in which no offset is applied to the second data DATA.

The MUX 620*i* may selectively output any one of the first sub-data and the second sub-data in response to the selection signal SEL supplied from the timing controller 310. The selection signal SEL may include photographing time point information, and may have a logical value of 0 (or OFF value) or 1 (or ON value) according to the photographing time point information. For example, when the selection signal SEL having a logic value of 0 is supplied, the MUX 620*i* may select and output the second sub-data to which the offset is not applied, and when the selection signal SEL having a logical value of 1 is supplied, the MUX 620*i* may select and output the first sub-data to which the offset is applied.

The digital-analog converter 630*i* may convert the first or second sub-data outputted from the MUX 620*i* as a data signal. For example, the digital-analog converter 630*i* may convert the first or second sub-data in a digital form outputted from the MUX 620*i* into an analog signal, and output the converted analog signal to the buffer 334*i*.

The buffer 334*i* may supply the analog signal outputted from the digital-analog converter 630*i* as a data signal to the data line DLi.

In an exemplary embodiment, when the MUX 620*i* may receive the selection signal SEL having a logical value of 1 to output the first sub-data to which the offset is applied and the digital-analog converter 630*i* and the buffer 334*i* supply the data signal converted from the first sub-data to the data line DLi, the luminance of the pixel receiving the data signal through the data line DLi may be changed (e.g., reduced or turned-off).

For example, referring to FIG. 4 to FIG. 7A, the data driver 330 may supply a data signal converted from the first sub-data to which the offset is applied through a data line (e.g., the data line DLi in FIG. 7A) connected to the first pixels PX1 disposed in an area overlapping the camera CM in the first display area DA1. Accordingly, the luminance of the first pixels PX1 disposed in the area overlapping the camera CM in the first display area DA1 corresponding to the photographing time point (i.e., first time point) information is altered (e.g., reduced or off).

Unlikely, when the MUX 620*i* receives the selection signal SEL having a logical value of 0 to output the second sub-data to which no offset is applied and the digital-analog converter 630*i* and the buffer 334*i* supply the data signal converted from the second sub-data to the data line DLi, the luminance of the pixel receiving the data signal through the data line DLi may not be altered.

In an embodiment, the sub-signal generator corresponding to the data line connected to the first pixels PX1 disposed in the area that does not overlap the camera CM in the first display area DA1 may not include the MUX 620*i*. In this case, the sub-signal generator may convert the second data DATA supplied from the latch 332 into an analog signal by using the digital-analog converter to supply it to the buffer 334, and the buffer 334 may supply the converted analog signal as a data signal to a corresponding data line. Accordingly, regardless of whether or not the camera CM captures an image, the first pixels PX1 disposed in an area of the first display area DA1 which do not overlap the camera CM may emit light with luminance which is not altered. However, the present inventive concept is not limited thereto, and for example, the sub-signal generator corresponding to the data line connected to areas (e.g., the surrounding area SA of FIG. 1) that is adjacent to the area overlapping the camera CM in the first display area DA1 may include a MUX 620*i*. As another example, each of the sub-signal generators 3331 to 333*m* may include the MUX 620*i*.

Components included in the sub-signal generator 333*i* may vary.

In an exemplary embodiment, as illustrated in FIG. 7B, the MUX 620*i*' may receive the first offset signal OS1 and the second offset signal OS2 from the offset circuit 610', and may select and output any one of the first and second offset signals OS1 and OS2 in response to the selection signal SEL. Sub-data in which the first or second offset signal OS1 or OS2 is applied to the data supplied from the latch 332*i*, may be supplied to the digital-analog converter 630*i*.

The offset circuit 610' may generate the first offset signal OS1 including the offset and the second offset signal OS2 not including an offset (or including an offset of 0) based on the offset control signal OCS supplied from the timing controller 310. In an exemplary embodiment, the offset may be substantially the same as the offset described with reference to FIG. 7A.

The sub-signal generator 333*i*' may generate a data signal based on data (i.e., second data DATA) supplied from the latch 332*i*, the first and second offset signals OS1 and OS2, and the selection signal SEL.

In an exemplary embodiment, the sub-signal generator 333*i*' may include a MUX 620*i*' and a digital-analog converter 630*i*.

The MUX 620*i*' may selectively output one of the first offset signal OS1 and the second offset signal OS2 according to the selection signal SEL supplied from the timing controller 310.

The digital-analog converter 630*i* may convert the first sub-data in which the first offset signal OS1 outputted from the MUX 620*i*' is applied to the data supplied from the latch 332*i* (that is, the first sub-data to which the offset is applied) or the second sub-data in which the second offset signal OS2 outputted from the MUX 620*i*' is applied to the data supplied from the latch 332*i* (that is, the second sub-data to which the offset is not applied) to an analog signal, and may output the converted analog signal to the buffer 334*i*.

In an exemplary embodiment, when the digital-analog converter 630*i* receives the first sub-data to which the first offset signal OS1 is applied, the digital-analog converter 630*i* and the buffer 334*i* may supply the data signal converted from the first sub-data to the data line DLi. Therefore, the luminance of the pixel receiving the data signal through the data line DLi may be altered (e.g., reduced).

For example, referring to FIG. 4 to FIG. 6 and FIG. 7B, the data driver 330 may supply a data signal converted from the first sub-data to which the first offset signal OS1 is applied through a data line (e.g., the data line DLi in FIG. 7B) connected to the first pixels PX1 disposed in the area overlapping the camera CM in the first display area DA1. Accordingly, the luminance of the first pixels PX1 disposed in the area overlapping the camera CM in the first display area DA1 corresponding to the photographing time point (i.e., first time point) information is altered (e.g., reduced or turned-off).

Unlikely, the digital-analog converter 630*i* receives the second sub-data to which the second offset signal OS2 is applied, the digital-analog converter 630*i* and the buffer 334*i* may supply the data signal converted from the second sub-data to the data line DLi. In this case, the luminance of the pixel receiving the data signal through the data line DLi may not be altered.

As described with reference to FIG. 4 to FIG. 7B, the luminance of the first pixels PX1 disposed in the area overlapping the camera CM in the first display area DA1 may be reduced at a time point when at least one camera module included in the camera CM captures an image, based on the data signal to which the offset is applied. Accordingly, the interference effect between the light emitted from the pixel (i.e., the first pixel PX1) and the light reflected from the subject and incident on the light receiver of the camera module may be minimized (or removed), thereby improving the quality of the captured image.

Figure 8A:
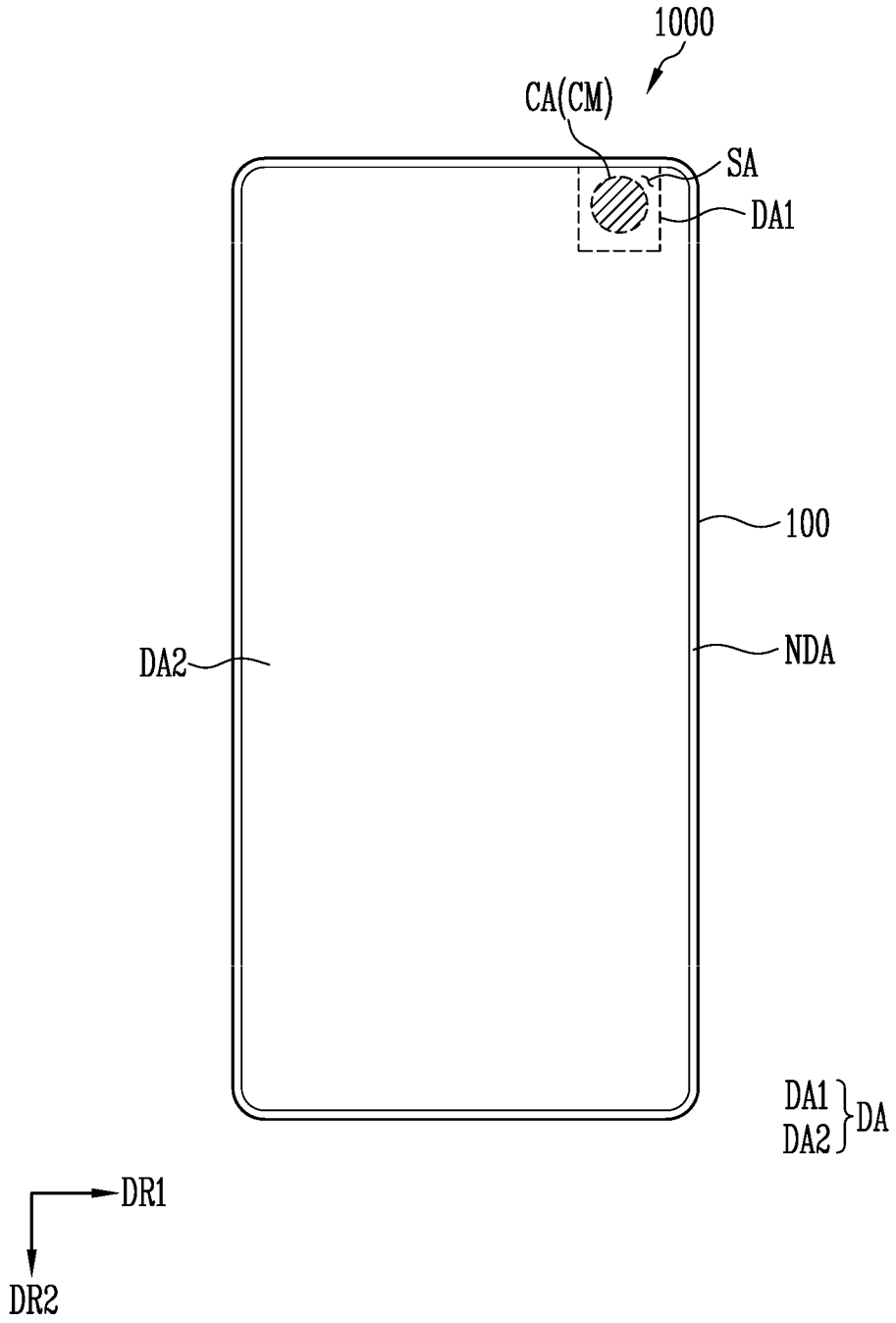
FIG. 8A and FIG. 8B illustrate examples of operations of the display device of FIG. 1.
Figure 8B:
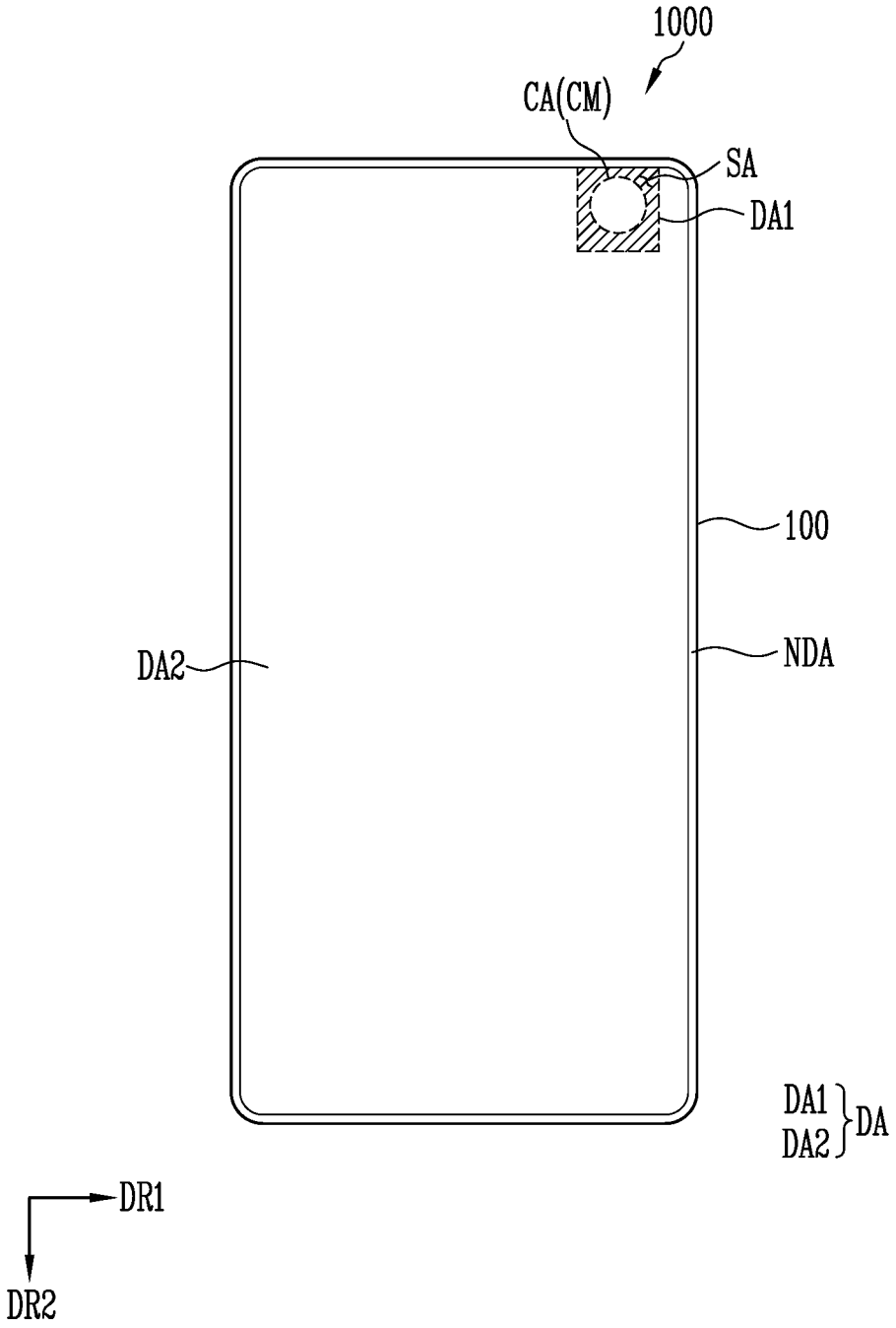

FIG. 8A and FIG. 8B illustrate examples of operations of the display device of FIG. 1.

In FIG. 8A and FIG. 8B, substantially the same or similar constituent elements described with reference to FIG. 1 will be denoted by the same reference numerals, and a repeated description thereof will be omitted.

Referring to FIG. 4 and FIG. 8A, the panel driver 300 may reduce the luminance of the first pixels PX1 disposed in the area overlapping the camera CM (that is, the camera area CA) in the first display areas DA1 as illustrated in FIG. 8A.

As described with reference to FIG. 1 to FIG. 3C, when an entire front surface of the display panel 100 is configured as the display area DA, a user may not recognize the position of the camera CM. In this case, the panel driver 300 may reduce the luminance of the first pixels PX1 disposed in the camera area CA to such an extent that the user can recognize a position of the camera CM, whereby the user may recognize the position of the camera CM according to the reduced luminance of the first pixels PX1 disposed in the camera area CA. For example, the panel driver 300 may reduce the first pixels PX1 disposed in the camera area CA to have reduced luminance (or luminance that is darker than the display area adjacent thereto) or turn off the first pixels PX1.

In addition, referring to FIG. 4 and FIG. 8B, the panel driver 300 may reduce the luminance of the first pixels PX1 disposed in the surrounding area SA adjacent to the camera area CA in the first display area DA1 as illustrated in FIG. 8B to such a degree that the user can recognize the position of the camera CM.

As illustrated in FIG. 8B, even when the panel driver 300 reduces the luminance of the first pixels PX1 disposed in the surrounding area SA to such a degree that the user can recognize the position of the camera CM, the panel driver 300 may supply the data signal converted from the sub-data to which the offset is applied at a time point corresponding to the photographing time point information through the data line connected to the first pixels PX1 disposed in the area overlapping the camera CM in order to minimize (or eliminate) the interference effect between the light emitted from the pixel and the light reflected from the subject and incident on the light receiver of the camera module.

Figure 9:
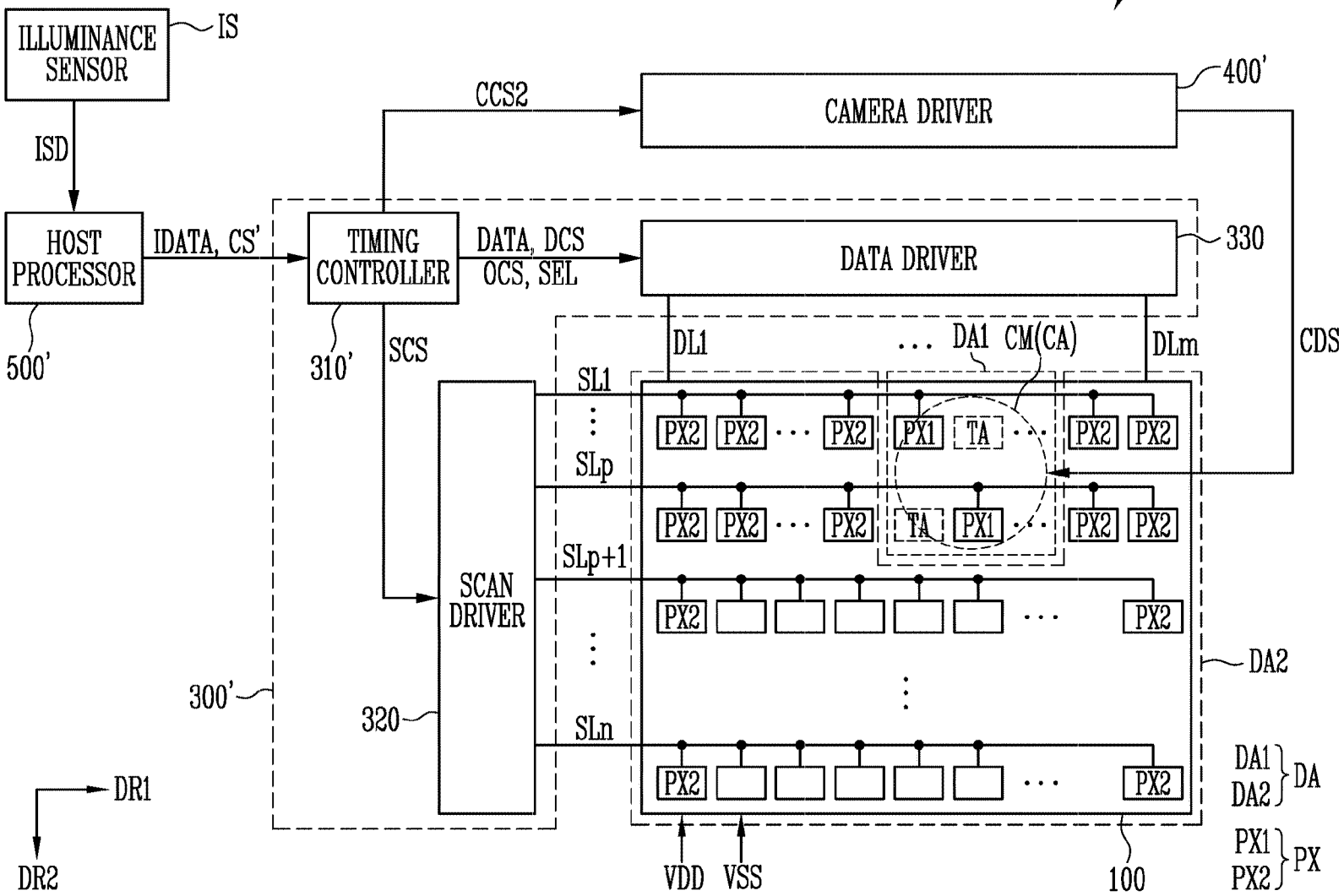
FIG. 9 illustrates a block diagram showing another example of the display device of FIG. 1.
Figure 10:
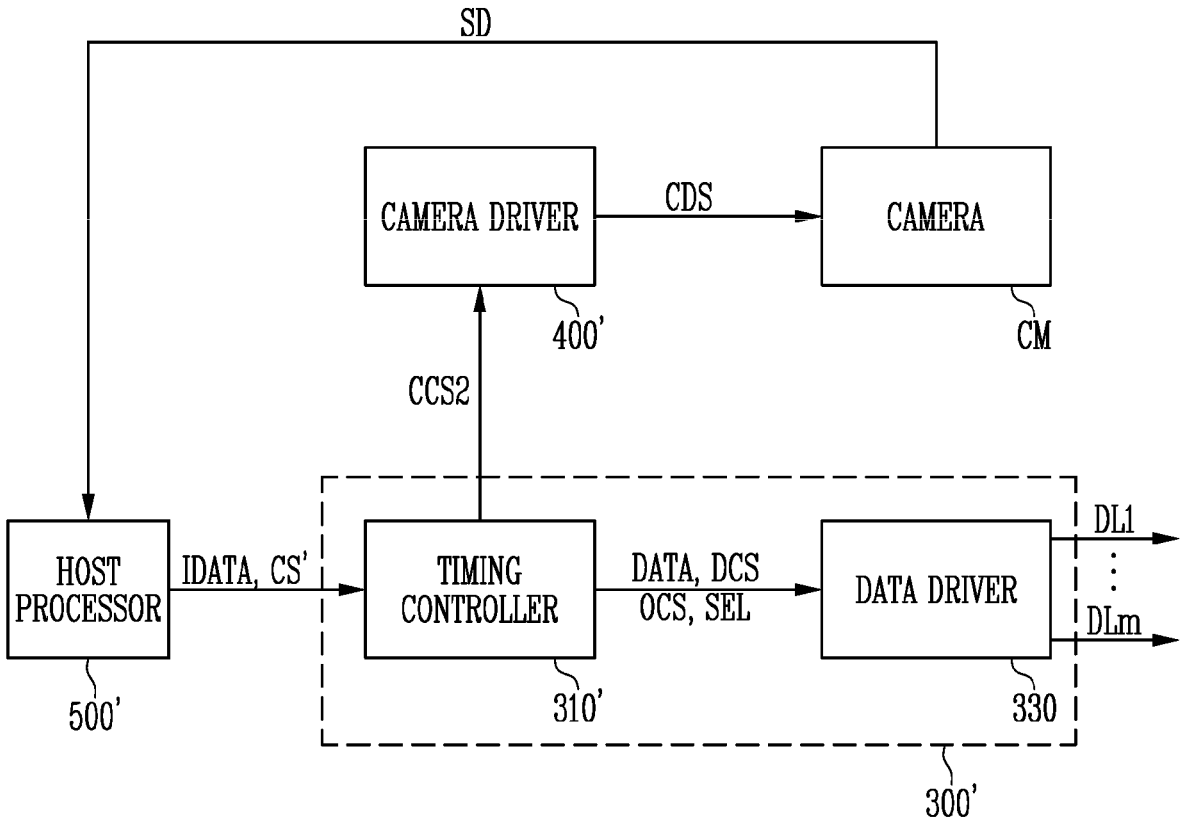
FIG. 10 illustrates an example of a host processor, a panel driver, a camera driver, and a camera included in the display device of FIG. 9.

FIG. 9 illustrates a block diagram showing another example of the display device of FIG. 1, and FIG. 10 illustrates an example of a host processor, a panel driver, a camera driver, and a camera included in the display device of FIG. 9.

In FIG. 9 and FIG. 10, substantially the same or similar constituent elements described with reference to FIG. 4 and FIG. 5 will be denoted by the same reference numerals, and a repeated description thereof will be omitted.

Referring to FIG. 9 and FIG. 10, a display device 1000' may include a display panel 100, a host processor 500', a panel driver 300', a camera driver 400', a camera CM, and an illuminance sensor IS.

Referring to FIG. 4, FIG. 5, FIG. 9, and FIG. 10, the host processor 500' of FIG. 9 and FIG. 10 is substantially the same or similar to the host processor 500 described with reference to FIG. 4 and FIG. 5 except that the timing controller 310' generates a camera control signal CCS2 and supplies it to the camera driver 400' in response to the control signal CS' supplied from the host processor 500', and thus a repeated description thereof will be omitted.

The panel driver 300' may supply data signals (or data voltages) to the first and second pixels PX1 and PX2. In an exemplary embodiment, the panel driver 300' may control luminance of at least some of the first pixels PX1 at the time point at which at least one camera module included in the camera CM captures an image.

In an exemplary embodiment, the panel driver 300' may reduce luminance of at least some of the first pixels PX1 from a predetermined time before at least one camera module included in the camera CM starts capturing an image to until the at least one camera module included in the camera CM finishes capturing the image. For example, the panel driver 300' may start controlling (e.g., reducing) the luminance of at least some of the first pixels PX1 from the predetermined time before the camera module starts capturing an image (second time point) and until the camera module finishes capturing the image (first time point). Herein, the predetermined time may correspond to a time enough to reduce the luminance of the first pixels PX1 disposed in the area overlapping the camera CM before the camera module starts capturing the image.

In an exemplary embodiment, the panel driver 300' may control the luminance of the first pixels PX1 disposed in the area (e.g., the camera area CA) overlapping the camera CM in the first display area DA1 from the second time point to the first time point. However, the present inventive concept is not limited thereto, and for example, the panel driver 300' may control luminance of the first pixels PX1 disposed in an area (e.g., the camera area CA) overlapping the camera CM and an area adjacent thereto (e.g., the surrounding area SA of FIG. 1) from the second time point to the first time point. As another example, the panel driver 300' may control luminance of the first pixels PX1 disposed in the first display area DA1 and luminance of at least some of the second pixels PX2 connected to the same scan lines (e.g., the first to $n^{th}$ scan lines SL1 to SLn) as the first pixels PX1 from the second time point to the first time point.

As such, the panel driver 300' may control (e.g., reduce) the luminance of at least some of the first pixels PX1 in advance before at least one camera module included in the camera CM captures an image, and thus prevent from capturing the image before the luminance of at least some of the first pixels PX1 is changed which may occur due to a signal delay or the like, thereby solving the problem that an effect of the interference between the light emitted from the pixel and the light reflected from the subject is not minimized.

The panel driver 300' may include a timing controller 310', a scan driver 320, and a data driver 330.

The timing controller 310' may generate an offset control signal OCS and a selection signal SEL based on the control signal CS'. In an exemplary embodiment, the timing controller 310' may generate the offset control signal OCS and the selection signal SEL during a period from the second time point to the first time point. Accordingly, the data driver 330 may supply a data signal obtained by converting data (or sub-data) in which the offset is applied to the second data DATA to at least some of the first pixels PX1 during a period from the second time point to the first time point, and the luminance of at least some of the first pixels PX1 (e.g., the first pixels PX1 disposed in the area overlapping the camera CM in the first display area DA1) is changed (e.g., reduced or turned-off) based on the data signal to which the offset is applied during the period from the second time point to the first time point. Accordingly, the luminance of the first pixels PX1 disposed in the area overlapping the camera CM is changed when the camera CM captures an image, and thus interference between light emitted from the first pixels PX1 and light reflected from the subject and incident on the light receiver of the camera CM may be reduced to improve the quality of the image captured by the camera CM.

The timing controller 310' may generate a camera control signal CCS2 for driving the camera CM. In an exemplary embodiment, the timing controller 310' may supply the camera control signal CCS2 to the camera driver 400' after the time point (i.e., second time point) at which the data driver 330 supplies a data signal to which the offset is applied (i.e., a data signal obtained by converting sub-data in which the offset is applied to the second data DATA) to at least some of the first pixels PX1.

The camera driver 400' may generate a camera driving signal CDS based on the camera control signal CCS2 supplied from the timing controller 310'. Herein, the camera driving signal CDS may include photographing time point information. The camera driver 400' may supply the camera driving signal CDS to the camera CM.

The camera module included in the camera CM may capture an image at a time point corresponding to the photographing time point information, based on the camera driving signal CDS supplied from the camera driver 400'. The camera CM may generate photographing data SD based on the captured image to supply the photographing data SD to the host processor 500'.

As described with reference to FIG. 9 and FIG. 10, the panel driver 300' may change the luminance of the first pixels PX1 disposed in the area of the first display area DA1 that overlaps the camera CM at the time point at which the camera CM captures an image (i.e., first time point) based on the data signal to which the offset is applied, thereby minimizing (or eliminating) an interference effect to improve the quality of the captured image. In addition, the panel driver 300' may change luminance of first pixels PX1 disposed in the area overlapping the camera CM in the first display area DA1 before the camera CM start capturing an image, and thus it can be prevented that the luminance of the first pixels PX1 disposed in the area overlapping the camera CM in the first display area DA1 may be changed after the time point at which the camera CM captures the image, without changing the luminance of the first pixels PX1 disposed in the area overlapping the camera CM at the time point at which the camera CM captures an image due to a signal delay or the like, thereby solving the problem that an effect of the interference between the light emitted from the pixel and the light reflected from the subject is not minimized.

Figure 11:
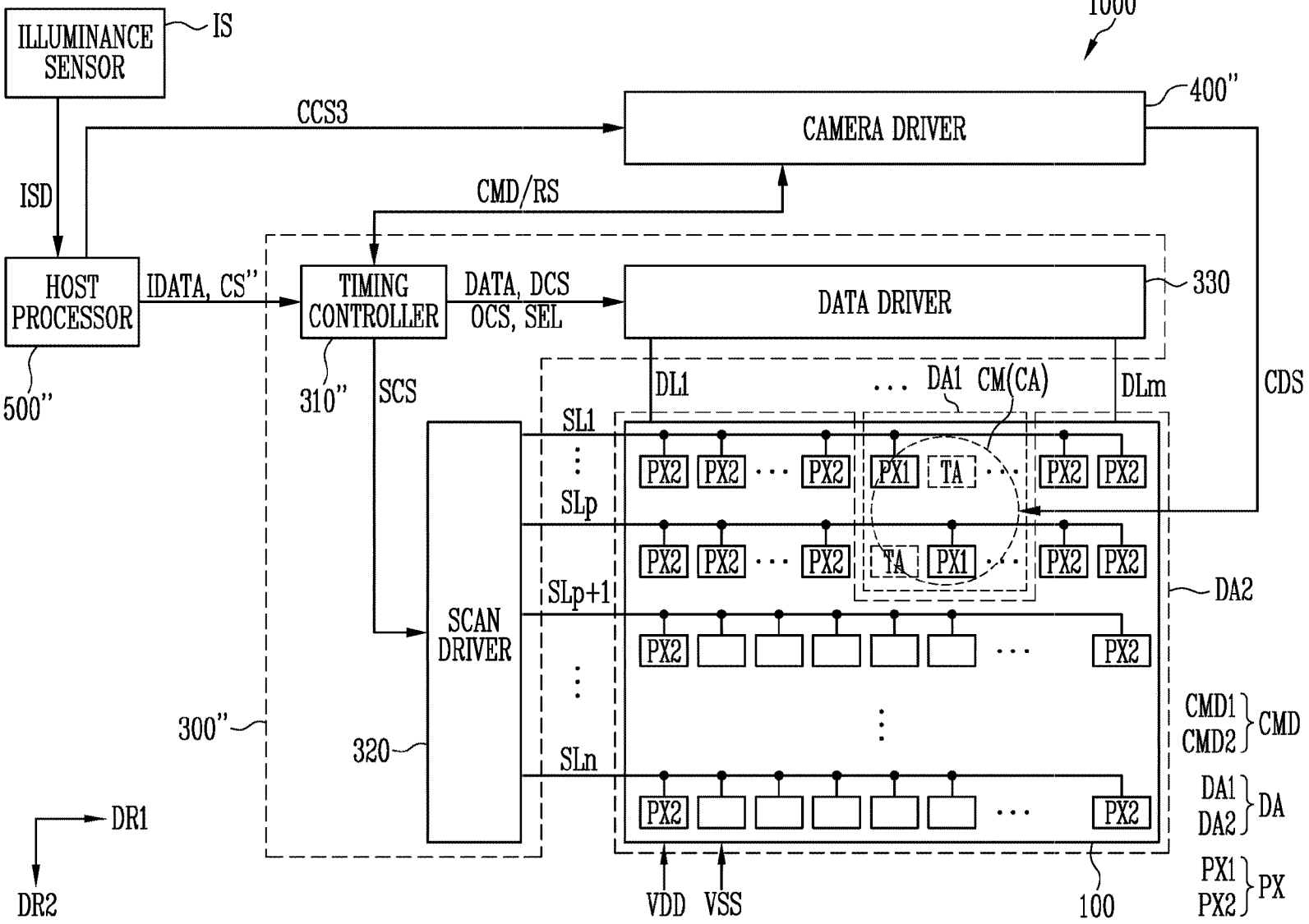
FIG. 11 illustrates a block diagram showing yet another example of the display device of FIG. 1.
Figure 12:
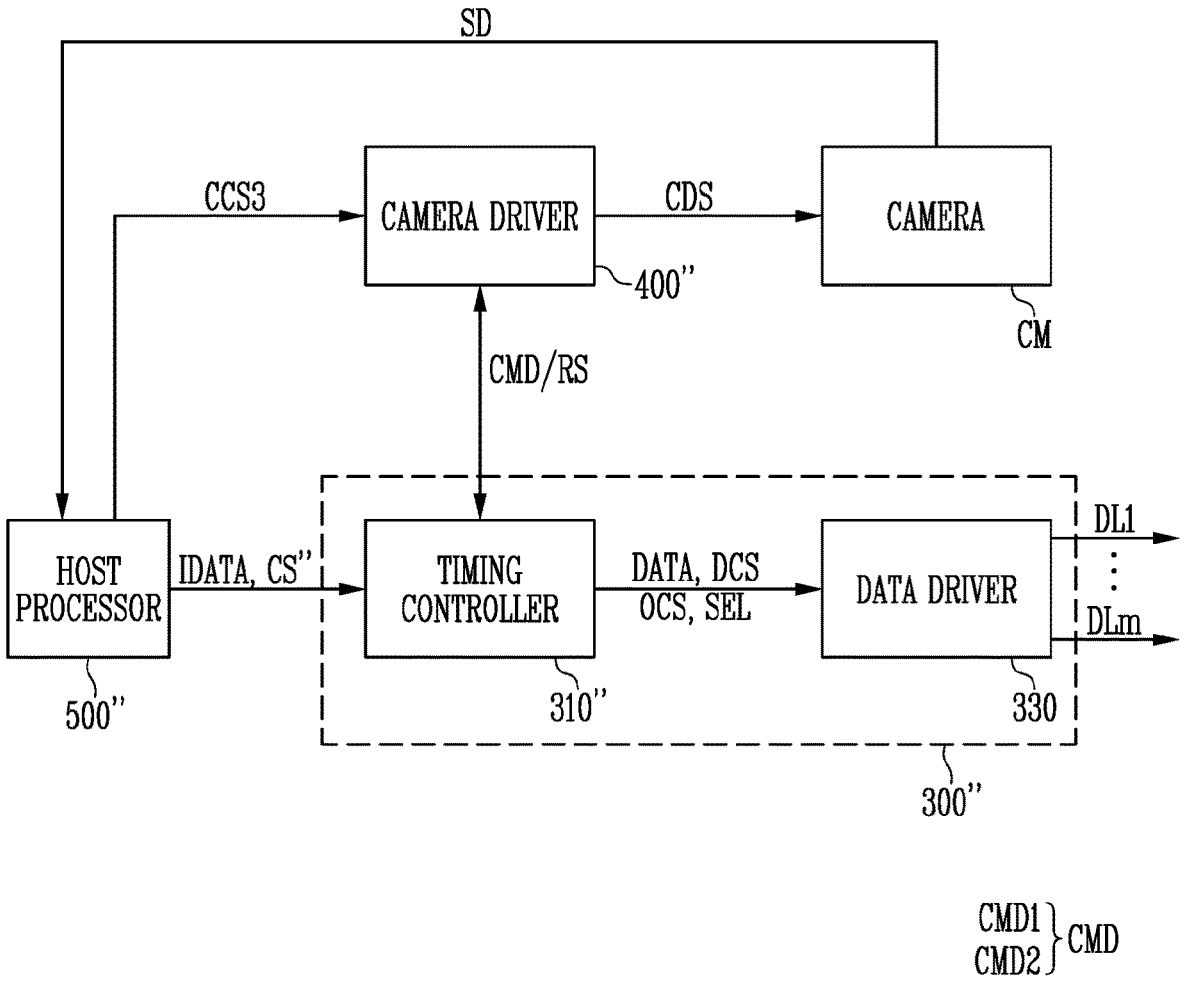
FIG. 12 illustrates an example of a host processor, a panel driver, a camera driver, and a camera included in the display device of FIG. 11.

FIG. 11 illustrates a block diagram showing yet another example of the display device of FIG. 1, and FIG. 12 illustrates an example of a host processor, a panel driver, a camera driver, and a camera included in the display device of FIG. 11.

In FIG. 11 and FIG. 12, substantially the same or similar constituent elements described with reference to FIG. 4 and FIG. 5 will be denoted by the same reference numerals, and a repeated description thereof will be omitted.

Referring to FIG. 11 and FIG. 12, a display device 1000" may include a display panel 100, a host processor 500", a panel driver 300", a camera driver 400", a camera CM, and an illuminance sensor IS.

The host processor 500" may supply a camera control signal CCS3 to the camera driver 400".

Subsequently, the camera driver 400" may transmit a first command CMD1 to the panel driver 300" which indicates that the camera control signal CCS3 is received from the host processor 500" in response to the camera control signal CCS3, and in response thereto, the panel driver 300" may transfer a response signal RS (e.g., an acknowledgment (ACK) signal) to the camera driver 400".

When the first command CMD1 is received from the camera driver 400", the panel driver 300" may control the luminance of at least some of the first pixels PX1. In an exemplary embodiment, the first command CMD1 may include information for reducing the luminance of at least some of the first pixels PX1 or turning off at least some of the first pixels PX1 (e.g., information for the timing controller 310" to generate the offset control signal OCS and the selection signal SEL).

In an exemplary embodiment, the panel driver 300" may exchange at least one command CMD and response signal RS with the camera driver 400" in order to control luminance of at least some of the first pixels PX1 from a predetermined time before at least one camera module included in the camera CM starts capturing an image to until the at least one camera module included in the camera CM finishes capturing the image.

For example, the panel driver 300" may control (reduce or turned-off) the luminance of at least some of the first pixels PX1 from a predetermined time before the time point at which the camera module takes an image (or second time point) until the second command CMD2 is received from the camera driver 400", based on the first command CMD1 supplied from the camera driver 400". The panel driver 300" may generate the response signal RS to supply it to the camera driver 400" after controlling the luminance of at least some of the first pixels PX1. The camera driver 400" may generate the camera driving signal CDS in response to the response signal RS. In this case, the luminance of at least some of the first pixels PX1 may be maintained in a controlled (e.g., reduced or turned-off) state at the time point at which the camera captures an image in response to the camera driving signal CDS. Accordingly, the panel driver 300" may maintain controlling of the luminance corresponding to the first pixels PX1 disposed in the area of the first display area DA1 that overlaps the camera CM (or the first pixels PX1 disposed in the surrounding area SA) until the time point at which the camera CM captures an image (i.e., first time point).

However, the present inventive concept is not limited thereto, and for example, the panel driver 300" may maintain controlling of the luminance of the first pixels PX1 disposed in the first display area DA1 and luminance of at least some of the second pixels PX2 connected to the same scan lines (e.g., the first to $n^{th}$ scan lines SL1 to SLn) as the first pixels PX1 from the second time point until the time point at which the camera module captures the image (that is, first time point).

Subsequently, when the photographing data SD is received from the camera CM, the host processor 500" may generate a camera control signal CCS3 including information related to photographing completion to supply it to the camera driver 400". The camera driver 400" may supply the second command CMD2 including information related to photographing completion to the panel driver 300" (or a timing controller 310") in response to the camera control signal CCS3. The panel driver 300" may stop luminance control of at least some of the first pixels PX1 in response to the second command CMD2.

As such, the panel driver 300" may control (e.g., reduce) the luminance of at least some of the first pixels PX1 by directly interfacing with the camera driver 400" in advance before at least one camera module included in the camera CM captures an image, and thus prevent from capturing the image before the luminance of at least some of the first pixels PX1 is changed which may occur due to a signal delay or the like, thereby solving the problem that an effect of the interference between the light emitted from the pixel and the light reflected from the subject is not minimized.

The above detailed description is to illustrate and describe the present inventive concept. In addition, the foregoing is only to describe and describe preferred embodiments of the present inventive concept, and as described above, the present inventive concept can be used in various other combinations, modifications and environments, and changes or modifications are possible within the scope of the concept of the inventive concept disclosed herein, the scope equivalent to the disclosures described, and/or within the scope of the skill or knowledge in the art. Accordingly, the detailed description of the inventive concept is not intended to limit the inventive concept to the disclosed exemplary embodiments. In addition, the appended claims should be construed to include other exemplary embodiments.

What is claimed is:

1. A display device, comprising:

a display panel which includes a first display area including a first pixel area in which first pixels are disposed and a transmissive area in which no pixel is disposed, and a second display area including a second pixel area in which second pixels are disposed;

a panel driver configured to supply an analog data signal to the first and second pixels; and a camera configured to include at least one camera module for capturing an image and disposed to overlap the first display area of the display panel, wherein the panel driver controls luminance of at least some of the first pixels in the first display area at a first time point at which the at least one camera module captures an image, wherein the panel driver includes:

a timing controller configured to convert first data into second data; and a data driver configured to generate the analog data signal based on the second data, wherein the timing controller generates an offset control signal and a selection signal including photographing time point information at the first time point in response to a control signal, and wherein the data driver includes:

an offset circuit configured to generate an offset applied to the second data based on the offset control signal; and a signal generator configured to generate the analog data signal corresponding to the at least some of the first pixels based on the second data, the offset, and the selection signal.

2. The display device of claim 1, wherein the panel driver reduces the luminance of the at least some of the first pixels or turns off the at least some of the first pixels at the first time point.

3. The display device of claim 1, further comprising:

a camera driver configured to supply a camera driving signal including the photographing time point information to the camera; and a host processor configured to supply a camera control signal to the camera driver and to supply the first data and the control signal to the panel driver, wherein the camera driver generates the camera driving signal in response to the camera control signal, and wherein the at least one camera module captures an image at the first time point based on the camera driving signal.

4. The display device of claim 3, further comprising:

an illuminance sensor configured to sense illuminance of ambient light of the display panel and to supply illuminance data corresponding to the illuminance to the host processor, wherein the offset is determined based on the illuminance data included in the control signal.

5. The display device of claim 1, wherein the signal generator includes:

a MUX configured to select one of first sub-data in which the offset is applied to the second data and second sub-data in which no offset is applied to the second data; and a digital-analog converter configured to convert the first sub-data or the second sub-data selected from the MUX into the analog data signal.

6. The display device of claim 5, wherein the signal generator supplies the analog data signal converted from the first sub-data to the at least some of the first pixels, and wherein the luminance of the at least some of the first pixels is changed based on the analog data signal converted from the first sub-data at the first time point.

7. The display device of claim 1, wherein the signal generator includes:

a MUX configured to select one of a first offset signal including the offset and a second offset signal including no offset in response to the selection signal; and a digital-analog converter configured to convert first sub-data in which the first offset signal is applied to the second data or second sub-data in which the second offset signal is applied thereto to the analog data signal.

8. The display device of claim 1, wherein the first pixels are disposed to have first density in an area of the first display area that overlaps the camera, and wherein the second pixels are disposed to have second density that is higher than the first density in the second display area.

9. A display device, comprising:

a display panel which includes a first display area including a first pixel area in which first pixels are disposed and a transmissive area in which no pixel is disposed, and a second display area including a second pixel area in which second pixels are disposed;

a panel driver configured to supply an analog data signal to the first and second pixels; and a camera configured to include at least one camera module for capturing an image and disposed to overlap the first display area of the display panel, wherein the panel driver controls luminance of at least some of the first pixels in the first display area at a first time point at which the at least one camera module captures an image, wherein the panel driver includes:

a timing controller configured to convert first data into second data; and a data driver configured to generate the analog data signal based on the second data, wherein the timing controller generates an offset control signal and a selection signal based on a control signal, and wherein the data driver includes:

an offset circuit configured to generate an offset applied to the second data based on the offset control signal; and a signal generator configured to generate the analog data signal corresponding to the at least some of the first pixels based on the second data, the offset, and the selection signal.

10. The display device of claim 9, further comprising:

a camera driver; and a host processor configured to supply the first data and the control signal to the panel driver, wherein the panel driver generates a camera control signal in response to the control signal, and wherein the camera driver is configured to supply a camera driving signal including photographing time point information corresponding to the first time point to the camera in response to the camera control signal.

11. The display device of claim 10, wherein the data driver generates sub-data to which the offset is applied to the second data based on the offset and the selection signal, and converts the sub-data into the analog data signal to supply the analog data signal to the at least some of the first pixels, and wherein the luminance of the at least some of the first pixels is changed based on the analog data signal converted from the sub-data.

12. The display device of claim 11, wherein the panel driver supplies the camera control signal to the camera driver after supplying the analog data signal converted from the sub-data to the at least some of the first pixels, wherein the camera driver generates the camera driving signal in response to the camera control signal, and wherein the at least one camera module captures an image at the first time point in response to the camera driving signal.

13. A display device, comprising:

a display panel which includes a first display area including a first pixel area in which first pixels are disposed and a transmissive area in which no pixel is disposed, and a second display area including a second pixel area in which second pixels are disposed;

a panel driver configured to supply an analog data signal to the first and second pixels;

a camera configured to include at least one camera module for capturing an image and disposed to overlap the first display area of the display panel;

a camera driver; and a host processor configured to supply a camera control signal to the camera driver and to supply first data to the panel driver, wherein the panel driver controls luminance of at least some of the first pixels in the first display area at a first time point at which the at least one camera module captures an image, wherein the camera driver generates a command in response to the camera control signal, wherein the panel driver controls the luminance of the at least some of the first pixels in response to the command, wherein the panel driver includes:

a timing controller configured to convert the first data into second data and to generate an offset control signal and a selection signal based on the command; and a data driver configured to generate the analog data signal based on the second data, and wherein the data driver includes:

an offset circuit configured to generate an offset applied to the second data in response to the offset control signal; and a signal generator configured to generate the analog data signal corresponding to the at least some of the first pixels based on the second data, the offset, and the selection signal.

14. The display device of claim 13, wherein the data driver generates sub-data to which the offset is applied to the second data based on the offset and the selection signal, and converts the sub-data into the analog data signal to supply the analog data signal to the at least some of the first pixels, and wherein the luminance of the at least some of the first pixels is changed based on the analog data signal converted from the sub-data.

15. The display device of claim 14, wherein the panel driver supplies a response signal to the camera driver after supplying the analog data signal converted from the sub-data to the at least some of the first pixels, wherein the camera driver is configured to supply a camera driving signal including photographing time point information corresponding to the first time point to the camera in response to the response signal, and wherein the at least one camera module captures an image at the first time point in response to the camera driving signal.

* * * * *